US005083539A

United States Patent [19]

Cornelio

[11] Patent Number: 5,083,539

[45] Date of Patent: Jan. 28, 1992

[54] CONCENTRIC ROTARY VANE MACHINE WITH ELLIPTICAL GEARS CONTROLLING VANE MOVEMENT

[76] Inventor: Seño L. Cornelio, P.O. Box 827, Dubai, U. A. E., Deira, Philippines

[21] Appl. No.: 600,922

[22] Filed: Oct. 19, 1990

[51] Int. Cl.[5] ..... F01C 1/077; F01C 19/00; F02B 53/12

[52] U.S. Cl. ..... 123/210; 123/245; 418/36; 418/141

[58] Field of Search ..... 123/245, 210; 418/36, 418/141

[56] References Cited

U.S. PATENT DOCUMENTS

| | | | |
|---|---|---|---|
| 2,342,515 | 2/1944 | Morgenstern | 418/36 |
| 2,450,150 | 9/1948 | McCulloch et al. | 418/36 |
| 3,112,062 | 11/1963 | Way | 418/36 |
| 3,430,573 | 3/1969 | Groeger | 418/36 |
| 3,769,946 | 11/1973 | Scherrer | 418/36 |
| 3,801,237 | 4/1974 | Gotthold | 418/36 |
| 4,028,019 | 6/1977 | Wildhaber | 418/36 |

FOREIGN PATENT DOCUMENTS

| | | | |
|---|---|---|---|
| 520694 | 5/1940 | United Kingdom | 418/36 |

*Primary Examiner*—John J. Vrablik

[57] ABSTRACT

In the concentric rotary pressure fluid machine which can either be an engine, motor, pump or compressor, the four identical elliptical gears (54, 54, 100, 100) actuate the relative rotary motions of two identical and coaxial rotors (60, 60') characterized by varying angular accelerations with respect to time equal in magnitude but opposite in direction. Consequently, the four arcuate variable-volume-chambers ( 1, 2, 3, 4) bounded by the arcuate rotor vanes (70, 70, 70', 70') analogous to opposed pistons of the piston-cylinder machine, and the rotor cylinders (80'), axial spacer (110), hollow cylindrical shell (20) and two transverse end plates (32, 32), functioning as cylinder block symmetrically and alternately enlarge and shrink in volumes in the prescribed manner as they revolve around their common axis.

4 Claims, 15 Drawing Sheets

| ROTATION IN DEGREES | | |
|---|---|---|
| INTER-MEDIATE GEARS α | FIRST ROTOR β | SECOND ROTOR γ |
| 0 | 0 | 0 |
| 5 | 8.7 | 2.8 |
| 10 | 17.4 | 5.7 |
| 15 | 25.7 | 8.6 |
| 20 | 33.6 | 11.6 |
| 25 | 40.8 | 14.6 |
| 30 | 47.1 | 17.7 |
| 35 | 52.6 | 20.9 |
| 40 | 57.4 | 24.4 |
| 45 | 61.7 | 28.3 |
| 50 | 65.6 | 32.6 |
| 55 | 69.1 | 37.4 |
| 60 | 72.3 | 42.9 |
| 65 | 75.4 | 49.2 |
| 70 | 78.4 | 56.4 |
| 75 | 81.4 | 64.3 |
| 80 | 84.3 | 72.6 |
| 85 | 87.2 | 81.3 |
| 90 | 90.0 | 90.0 |

CONCENTRIC ROTARY VANE MACHINE WITH ELLIPTICAL GEARS CONTROLLING VANE MOVEMENT

BACKGROUND OF THE INVENTION

1. Field of the Invention

The present invention relates to internal and external combustion engines, hydraulic motors, liquid pumps, vacuum pumps and compressors, and in particular to concentric rotary types.

2. Description of Related Art

The invention is a plurality of pressure fluid machines which are analogs of the opposed pistons-cylinder reciprocating internal and external combustion engines, hydraulic motors, liquid pumps, vacuum pumps and compressors, as well as the gas-turbine engine.

The piston-cylinder reciprocating machinery is widely known and well understood to the degree that it is not necessary to discuss all of them in this document. Sufficient for the purpose is the terse description of the piston-cylinder internal combustion engine whose analog in the present invention is given more significance and space.

The conventional piston-cylinder reciprocating internal combustion engine is inefficient because it has valves and valve springs costing one third ($\frac{1}{3}$) of heat of combustion to protect from destructive high temperature; its linearly reciprocating piston motion is converted with power losses into rotary crank shaft movement; its relatively short strike favors incomplete combustion; and its several parts result to expensive initial and maintenance costs as well as heavy weight to power ratio.

In the attempt to overcome these shortcomings and problems of the conventional piston-cylinder engine, a number of rotary engines were conceived. However, they have inherent problems impeding their development and widespread acceptance. Only the Wankel rotary engine has succeded in the production line although it is also beset with rotor sealing problems, high fuel consumption and poor consumption efficiency.

One version of the invention is analogous to the gas turbine external combustion engine generally used in jet planes and power generating plants, having separate compressor and expander turbine connected by a combustor. Because it operates at excessive speed and temperature, its construction is expensive and its useful life is short.

In both internal and external combustion engines, hydraulic motors, liquid pumps, vacuum pumps and compressors, of reciprocating and rotary types, economy in use of materials for parts and high operating efficiency are promoted if all tangential components of the forces created and absorbed by the primary moving parts such as pistons and rotors are additive and have positive sense. Unfortunately, this condition is absent in most of the pressure fluid machines in the present state of the art.

SUMMARY OF THE INVENTION

The concentric rotary internal combustion engine is given more importance and coverage in the following specification and drawings in order to simplify the presentation and facilitate the understanding of the invention. Although less space is devoted to the illucidation of the concentric rotary external combustion engines, hydraulic motor, liquid pump, vacuum pump and compressor, the description of the concentric rotary internal combustion engine is the same with theirs in most respects. Their minor differences readily surface out without going into details.

The concentric rotary internal combustion engine is invented to compete with the conventional piston cylinder reciprocating internal combustion engine and the Wankel rotary internal combustion engine in mechanical and thermal efficiency, cost and weight to power ratio.

The above object is achieved in the four stroke concentric rotary internal combustion engine which is the analog of the opposed piston-cylinder engine. Higher mechanical efficiency is achieved because the forces tangential to the motion of the vanes are additive. Although adjacent vanes revolve in the same direction, their relative movement with respect to the combustion chamber is always symmetrical. Hence, during the power phase, the high pressure resulting from the combustion process pushes the front vane to advance and the rear vane to recede related to the center of the combustion chamber. Pulling forward the rear vane at this instance would stop the engine because the action is tantamount to reversing the rotation of the main shaft.

This is not the case in both piston-cylinder and Wankel engines. The triangular rotor of the Wankel engine can be considered as a lever with the pivot located between the ends. Consequently, during the power phase, part of the torque accomplished by the expanding hot gases in the front portion of the triangular rotor is balanced by the reversing torque created at its rear portion, resulting to big power wastage. On the other hand, no torque is produced when the high pressure resulting from the combustion process acts upon the cylinder head of the piston-cylinder reciprocating internal combustion engine.

The concentric rotary engine exhibits high thermal efficiency because aside from having high mechanical efficiency elaborated above, it operates at maximum possible temperature, water-cooling system is absent, friction is minimal and porting of the combustion media is continuous and not constricted.

Since the concentric rotary internal combustion engine has no valves and springs to protect from high temperature, water-cooling system is not required and it can run safely at maximum possible temperature. The heat accumulated in the engine is absorbed by the combustion media increasing the combustion temperature. As working temperature goes up, so is the thermal efficiency of the engine. For there are no valves to protect from expanding and breaking the cylinder head, no springs from relaxating and setting making the engine inoperative, and cylinder head from thermal distortion breaking it, the radiator and water cooling system is elliminated, concomittantly saving about one third of the heat combustion which is normally extracted by such cooling system, and which now becomes available for conversion into torsional moment.

Moreover, less friction is encountered inside the engine because the rotating parts and stationary parts are concentric and coaxial, gases trapped in grooves in rubbing parts of the vanes serves as effective seal and lubricant, and the bearings and elliptical gears are in oil bath.

The ellimination of water cooling system and lubricating system for the combustion chamber as well as the reduction in the number and weight of parts of the concentric rotary internal combustion engine promote cheap initial and maintenance costs, and light weight to power ratio.

Moreover, its relatively long stroke spanning 90° favors effective cooling of the rotor and working chamber by air convection during the intake phase, thorough mixing of fuel and air during the intake and compression phases as well as complete combustion during the power stroke.

Finally, the concentic rotary internal combustion engine has big combustion media inlet and outlet remaining open always, promoting continuous gas inflow and outflow into and from the engine, and elliminating surging phenomena and problems associated with valves that suddenly and intermittently close and open. Considering that the rotating parts of the concentric rotary internal combustion engine are symmetrical and move symmetrically with respect to the combustion chambers, vibration and noise problems can be softened in the engine.

The concentric rotary internal combustion engine has four elliptical gears actuating the four arcuate combustion chambers to vary in volumes as they revolve around the axis in the prescribed manner complying with what is required in the four stroke Otto internal combustion cycle.

The four arcuate vanes which are sections of a right circular cylinder, travel around an annular working chamber bounded by the hollow cylindrical shell, pair of rotor cylinders and their spacer, and pair of transverse end plates. Diametrically opposing vanes are rigidly connected to a rotor cylinder which has an elliptical gear mounted in its shaft. This elliptical gear in turn is enmeshed with an intermediate elliptical gear mounted in the main shaft which is parallel to the two coaxial rotors. Since there are four vanes, there are two coaxial rotor cylinders with spacer, two rotor shafts projecting outwardly and coaxially from said rotor cylinders and journalled for rotation in the front and rear gear box bodies and cover plates, and two elliptical gears mounted in said rotor shafts inside the gear boxes. Consequently, there are also two intermediate elliptical gears mounted in the main shaft, enmeshed with the rotor elliptical gears inside the front and rear gear boxes. Clearly, the rotary motions of the rotors, and hence, the vanes, are controlled by the four identical elliptical gears.

The concentric rotary internal combustion engine can be likened to an opposed piston-cylinder reciprocating internal combustion engine because the four arcuate vanes of the invention stand for the opposed pistons and the arcuate combustion chambers that they define inside the annular working chamber correspond to the combustion chamber common to both opposed pistons. Although the four arcuate combustion chambers vary in volumes, they are always 90° apart and equidistant with each other.

As the four arcuate combustion chambers as an assembly rotate at constant angular velocity, the two rotors and their vanes rotate at varying angular velocities but having equal absolute values of their differences from the angular velocity of the combustion chambers, and at varying angular accelerations equal in magnitude but opposite in direction. Consequently, the four arcuate combustion chambers defined by the vanes inside the annular working chamber alluded above increase and decrease in volumes twice every revolution around the axis. During the enlarging of each combustion chamber, its rear vane revolves slower than the combustion chamber while its front vane revolves at faster rate, causing the angular space between said vanes to enlarge. Whereas during the shrinking of each combustion chamber, its rear vane revolves faster than the combustion chamber while its front vane revolves at slower rate, causing the angular space between said vanes to shrink.

During the intake phase, the combustion chamber increases in volume while passing by the inlet effecting the drawing in of fuel-air mixture via the carburetor. From the time the rear vane leaves behind the inlet till the combustion chamber shrinks to minimize volume, the fuel-air mixture is compressed. Suddenly, the spark plug fires igniting the explosion of the fully compressed combustion media. The combustion chamber enlarges during the power phase. Then, the exhaust gases is discharged through the outlet as the combustion chamber shrinks the second time while passing by the exhaust outlet.

The concentric rotary internal combustion engine is equivalent to an eight cylinder reciprocating internal combustion engine of the same combustion chamber displacement and compression ratio because both perform eight complete four stroke Otto cycles every two revolutions.

While the concentric rotary internal combustion engine has one inlet and outlet, the concetric rotary external combustion engines, hydraulic motor, liquid pump, vacuum pump and compressor have two inlets and two outlets.

DESCRIPTION OF DRAWINGS

The accompanying drawings show the preferred embodiment of the invention, in which.

Similar numerals of reference refer to corresponding parts in the different Figs. of the drawings.

DESCRIPTION OF PREFERRED EMBODIMENT OF THE INVENTION

The following analysis enumerates and describes the various parts of the invention, explains how they are assembled and mounted; delves on the kinematics of the rotors, vanes and combustion chambers based on empirical data; studies the torsional moments absorbed and created during the internal combustion process; clarifies the various phases of the four stroke Otto cycle; arrives at a theoretical formula for determining the net power output of the concentric rotary internal combustion engine; and elaborates briefly on the concentric rotary external combustion engines, hydraulic motor, liquid pump, vacuum pump and compressor.

PARTS

Figure 1:
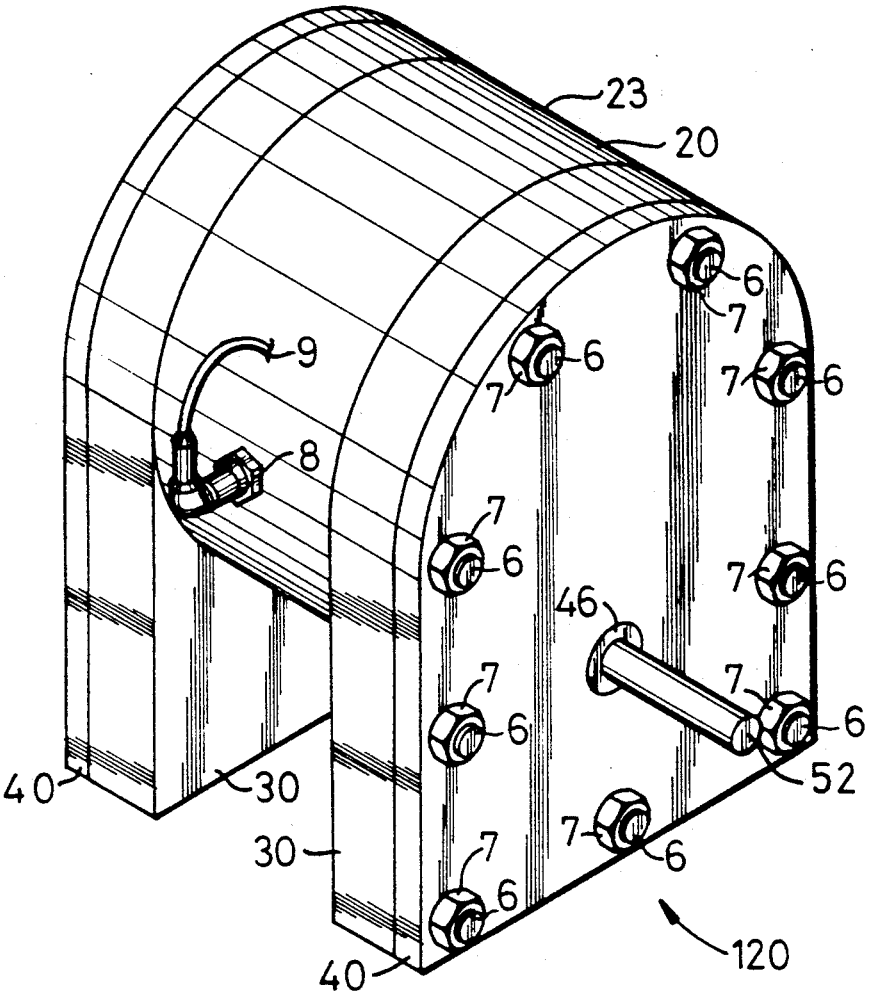
FIG. 1 is the front view isometric drawing of the concentric rotary internal combustion engine showing its external features.

The concentric rotary engine 120 of FIG. 1 can be divided in two ways. First, it can be analyzed in FIGS. 2, 3, 4, 5 and 6 as comprising two identical gear boxes 130, 130 and the working chamber 140 in between them.

Gear Box

Figure 3:
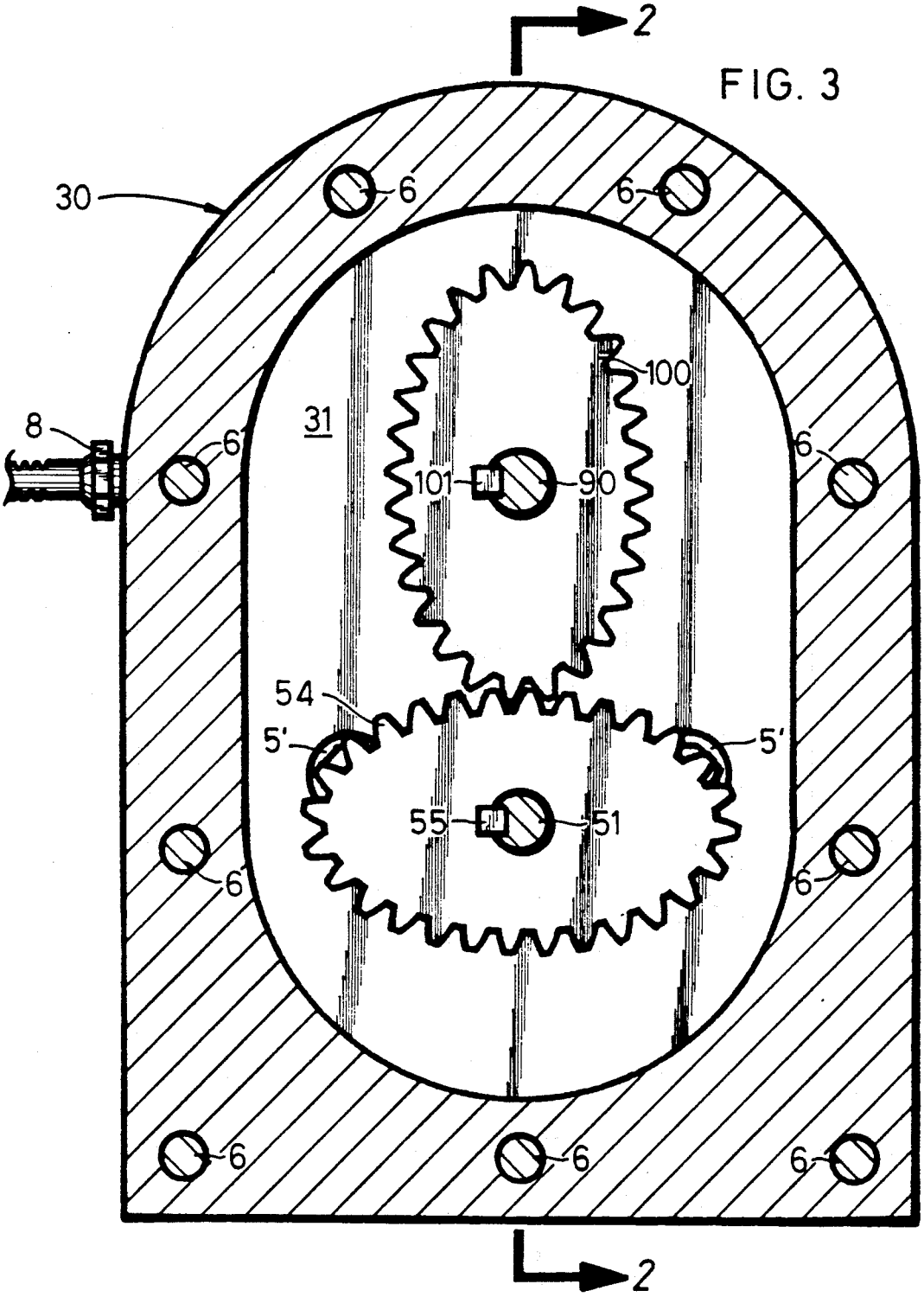
FIG. 3 is the transverse section of the concentric rotary internal combustion engine along section line 3—3 of FIG. 2 showing the internal features of the gear box (FIG. 3 becomes applicable also to the concentric rotary external combustion engine, hydraulic motor, liquid pump, vacuum pump and compressor when the spark plug (8) is elliminated in the drawing.)

Since the front and rear gear boxes 130, 130 are identical, both FIG. 3 (except for the position of the spark plug 8) and the following description are applicable to both of them.

Each gear box 130 basically consists of the gear box body 30, gear box cover plate 40, two elliptical gears 54, 100, rotor shaft 90 and main shaft 51.

Not shown but understood to be included in the gear box 130 are the inlet and outlet oil plugs for filling up and draining it with lubricating oil.

Working Chamber

Figure 4:
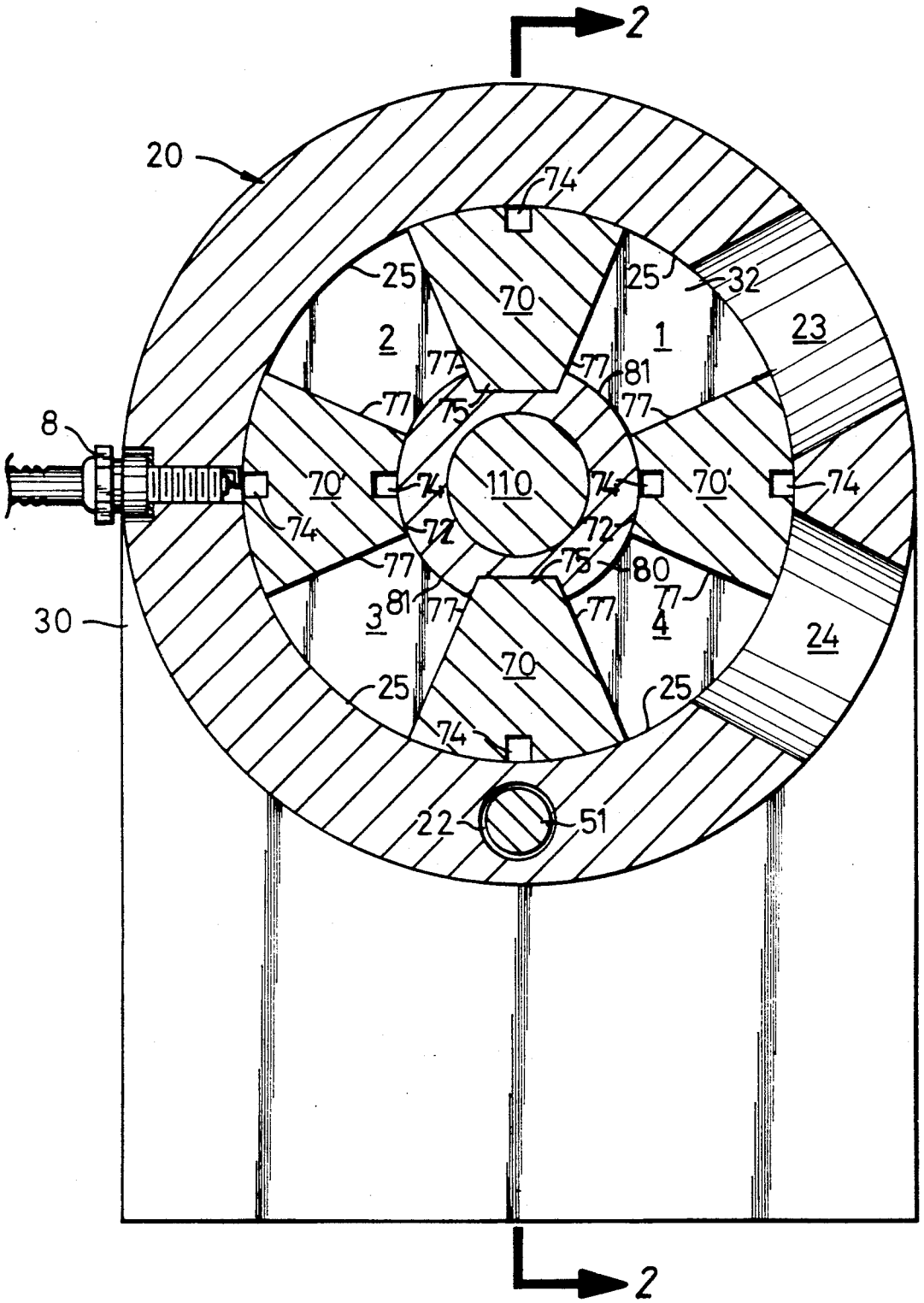
FIG. 4 is the transverse section of the engine along section line 4—4 of FIG. 2 showing the internal features of the working chamber when its four arcuate combustion chambers have equal mean volumes.
Figure 5:
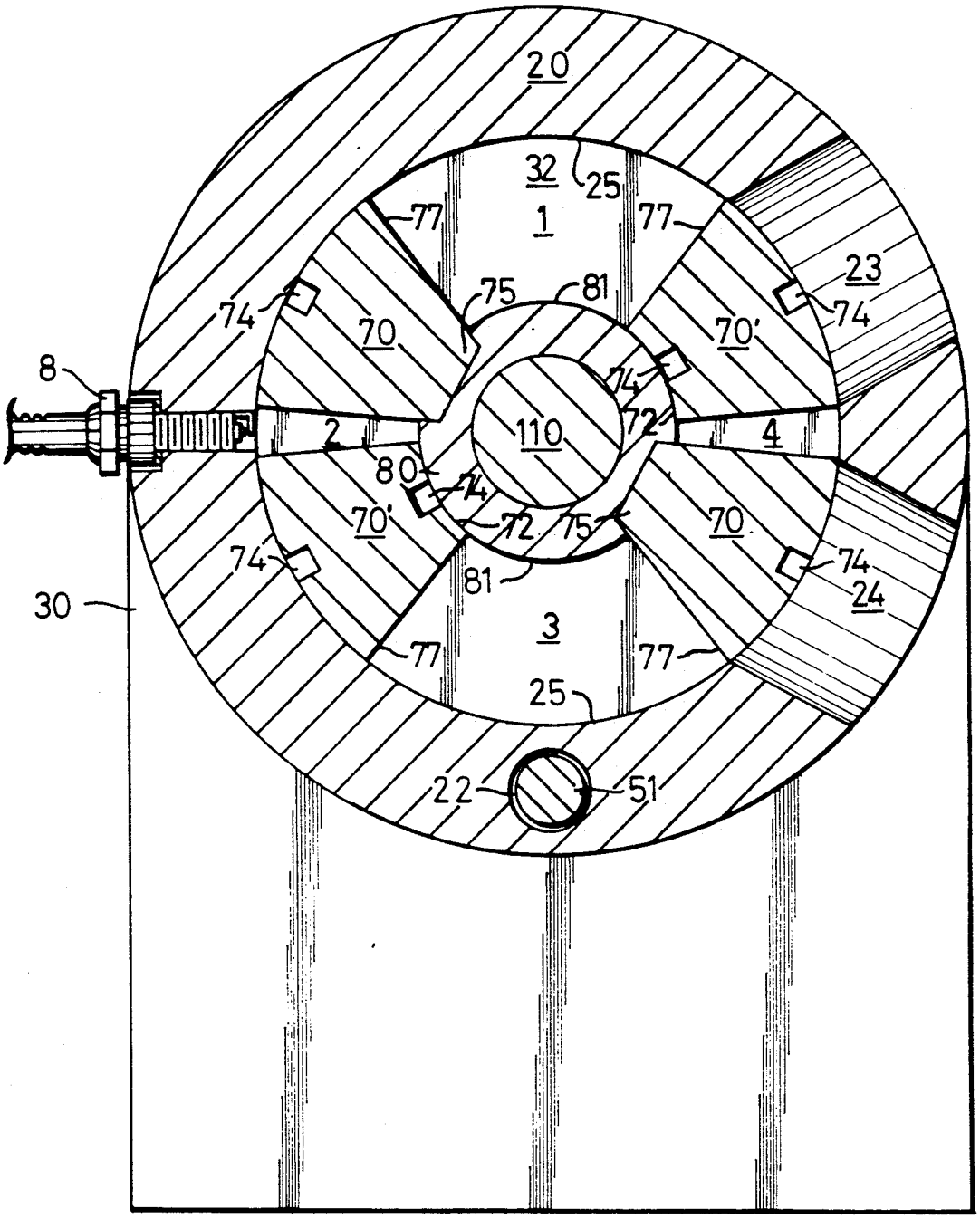
FIG. 5 is the same transverse section of the concentric rotary internal combustion engine as in FIG. 4 showing the internal features of the working chamber when its pair of opposing vertical arcuate combustion chambers have maximum volumes while its pair of opposing horizontal arcuate combustion chambers have minimum volumes.

FIG. 4 presents the working chamber 140 when its four arcuate combustion chambers 1, 2, 3, 4 are diagonally oriented and having equal mean volumes. The mean volume is half the sum of maximum and minimum volumes of the combustion chamber 1, 2, 3 or 4. On the other hand, FIG. 5 shows the working chamber 140 when its pair of vertically opposing combustion chambers 2, 4 are having maximum volumes and its pair of horizontally opposing combustion chambers 1, 3 are having minimum volumes.

In all cases, the combustion chambers 1, 2, 3, 4 are always perpendicular to adjacent ones and aligned with the one opposite it. The enlarging and shrinking of the combustion chambers 1, 2, 3, 4 are symmetrical with respect to their diametrical plane bisectors, brought about by utilization of four identical elliptical gears 54, 54, 100, 100 to actuate the relative rotary movements of the rotors 60, 60'.

In all cases, the angular velocities of adjacent vanes 70, 70' have equal absolute values of their differences from the angular velocity of the combustion chamber they define.

Again, in all cases, the angular accelerations of adjacent vanes 70, 70' are equal in magnitude but opposite in directions.

However, since opposite vanes 70, 70 or 70', 70' are rigidly mounted in a common rotor cylinder 80 or 80', they always have the same angular velocity, angular acceleration and directional sense.

The working chamber 140 basically consists of four arcuate combustion chambers 1, 2, 3, 4 defined by the internal circumferential surface 25 of the shell 20, the longitudinal surfaces 77, 77, etc. of the vanes 70, 70, 70', 70', the circumferential surfaces 81, 81 of the rotor cylinders 80, 80', the rim of disc 111 of the spacer 110, and the transverse end plates 32, 32.

Figure 8:
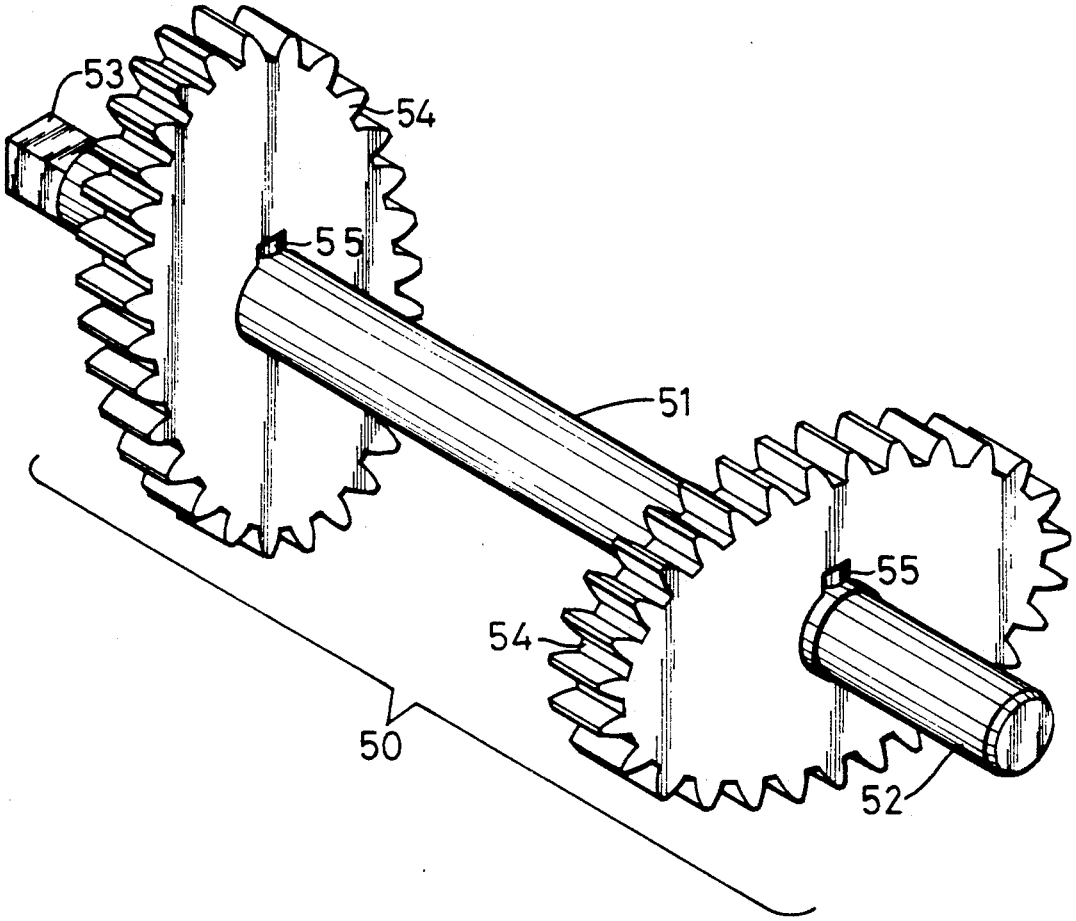
FIG. 8 is the isometric drawing of the intermediate eliptical gears and main shaft assembly common to the concentric rotary internal and external combustion engines, hydraulic motor, liquid pump, vacuum pump and compressor.
Figure 9:
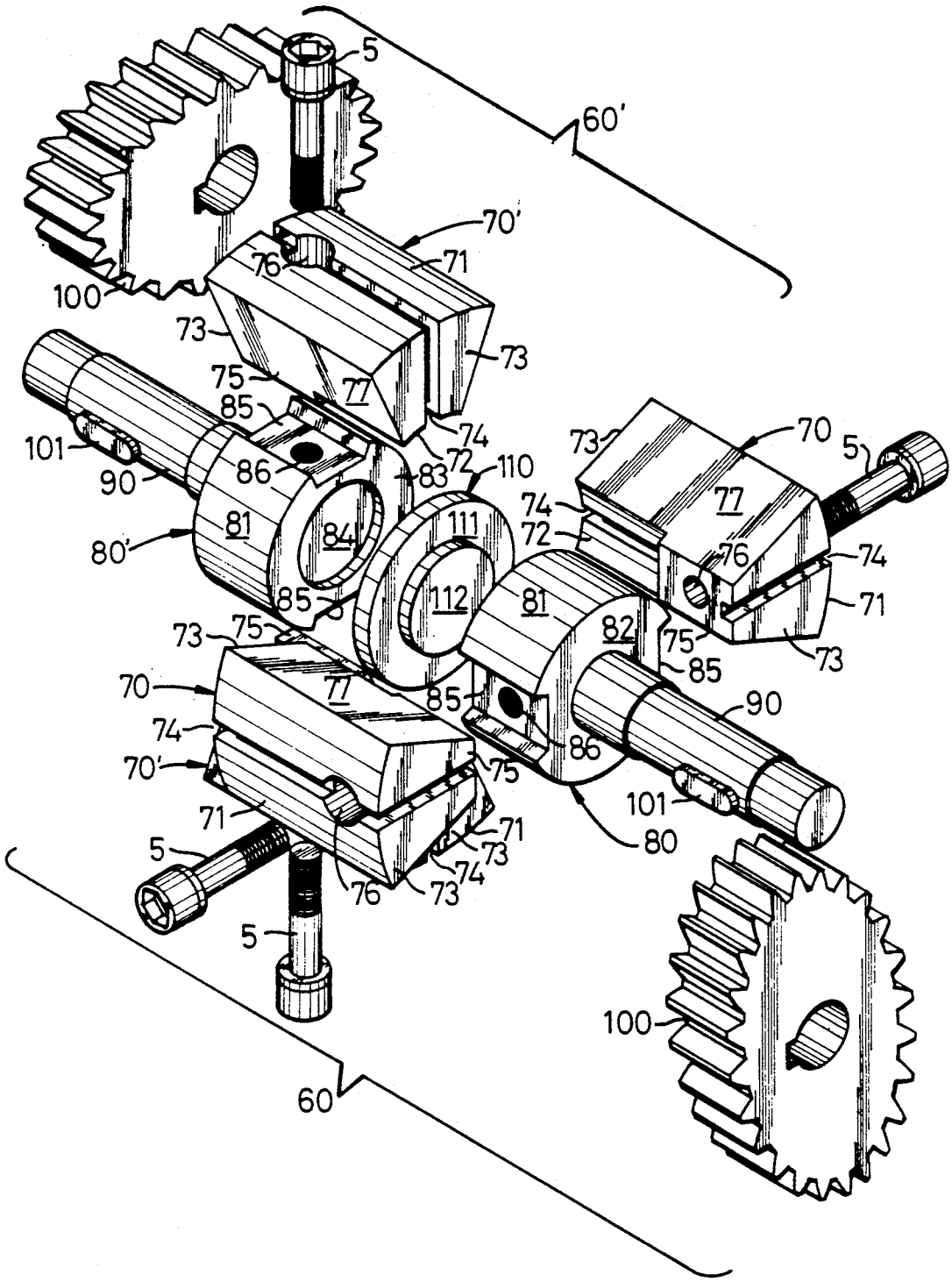
FIG. 9 is the exploded isometric drawing of the two rotors and their spacer common to the concentric rotary internal and external combustion engines, hydraulic motor, liquid pump, vacuum pump and compressor.

The concentric rotary internal combustion engine 120 is divisible in another way. It can be divided into the stator 10 (FIG. 7), rotors 60, 60' and their spacer 110 (FIG. 9), and the intermediate elliptical gears and main shaft assembly 50 (FIG. 8). The stator 10 is the stationary part supporting the rotating parts; the rotors 60, 60' and their spacer 110 are the primary rotating part performing the four stroke Otto internal combustion cycle; while the intermediate elliptical gears and main shaft assembly 50 is the secondary rotating part applying starting power input to and transmitting power output from the rotors 60, 60'.

Stator

Figure 7:
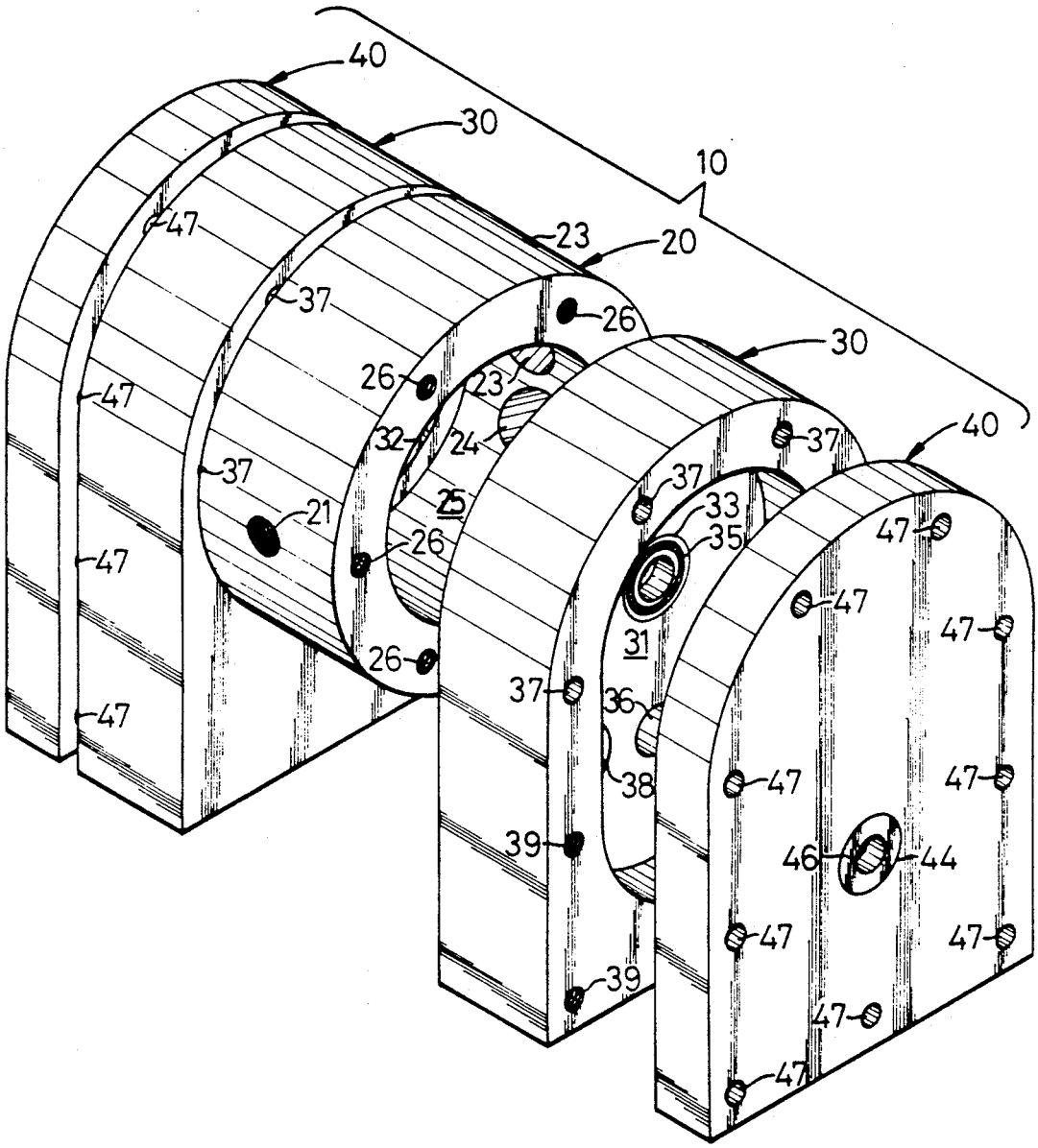
FIG. 7 is the isometric drawing of the stator of the concentric rotary internal combustion engine excluding the fasteners.

FIG. 7 shows the stator 10 of the concentric rotary internal combustion engine 120 to consist of the hollow cylindrical shell 20 in the middle, two identical gear box bodies 30, 30 in front and rear transverse sides of the said shell 20, and two identical gear box cover plates 40, 40 at the ends, held together in leak-proof relationship by means of countersunk Allen screws 5, 5, etc., stud bolts 6, 6, etc., and nuts 7, 7, etc.

Shell

The axial section of the shell 20 is exhibited in FIGS. 4 and 5. On its left side is the horizontal threaded radial hole 21 (FIG. 7) into which the spark plug 8 is screwed. At its bottom is the longitudinal hole 22 through which the main shaft 51 passes from rear to front parallel to the axis. On its right side are two identical radial holes, namely, the inlet 23 above the horizontal line perpendicular to the axis which is connected to the carburetor and air filter (which are not shown in the drawings), and the outlet 24 below the horizontal line to which the exhaust pipe (also not shown in the drawings) attaches.

The axes of the inlet 23 and outlet 24 alluded above pass through the center of the shell 20. Their common diameter is equal to the circumferential width of the vane 70 as measured on the internal circumferential surface 25 of the shell 20. They are equally spaced from the horizontal line passing through the center of the shell 20 by half the minimum space of combustion chamber 1, 2, 3, or 4 from edge to edge.

Consequently, in FIG. 5, just after the power phase of the combustion chamber 3, its front vane 70 is in exact registration with the outlet 24; and just after the exhaust phase of the combustion chamber 4, its front vane 70' is in exact registration with the inlet 23.

The shell 20 has threaded longitudinal blind holes 26, 26, etc. along its periphery for fixing stud bolts 6, 6, etc. and countersunk Allen screws 5, 5, etc.

Gear box body

Figure 2:
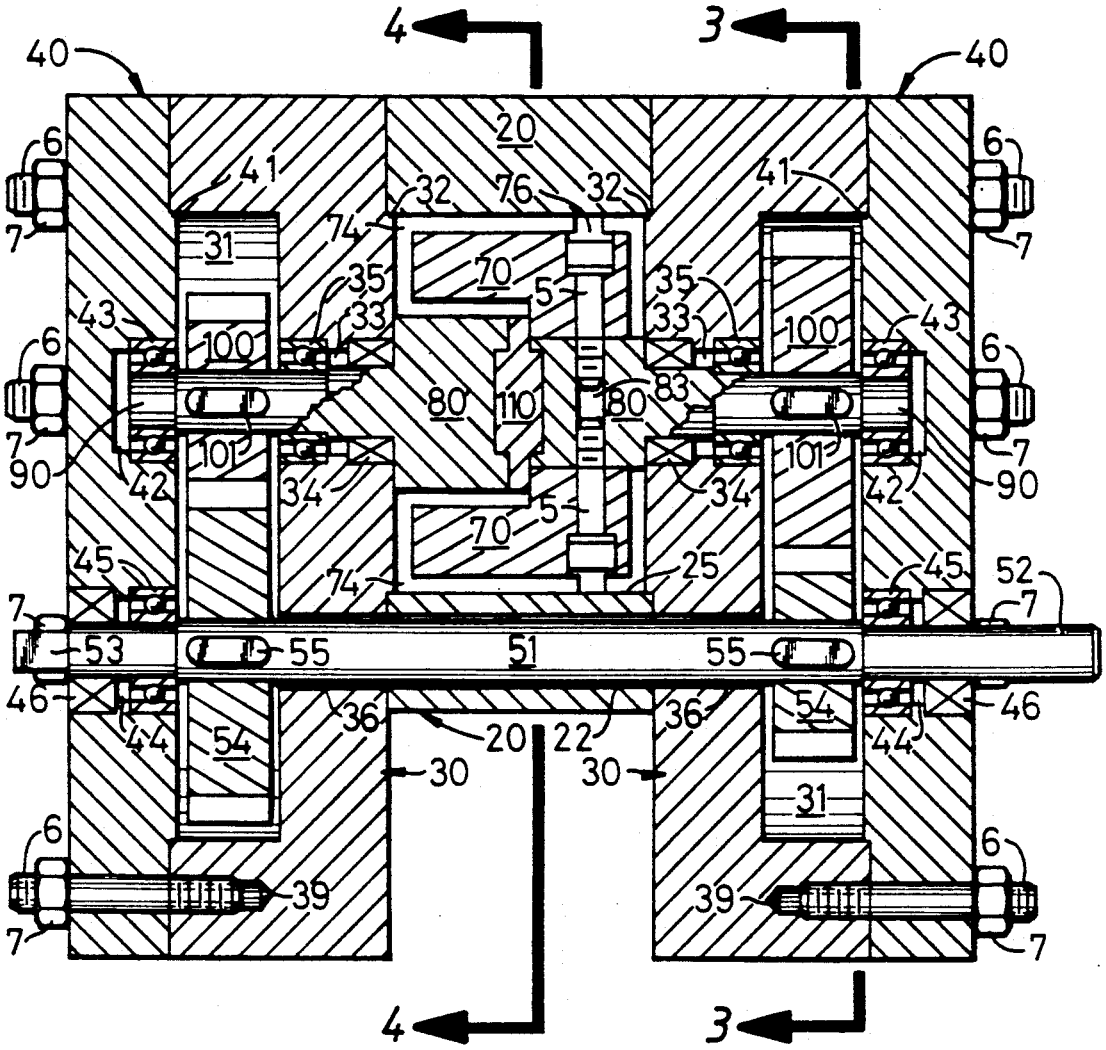
FIG. 2 is the common longitudinal section of both the concentric rotary internal combustion engine along section line 2—2 of FIGS. 3 and 4, and the concentric rotary external combustion engine, hydraulic motor, liquid pump, vacuum pump and compressor along section line 2—2 of FIG. 15 showing the internal features of the invention.

FIGS. 2, 3, 6 and 7 pictorially describe the gear box body 30 as a thick plate with oblong recess 31 in the external transverse side, i.e., outward from the working chamber 140, to accommodate the rotor elliptical gear 100, intermediate elliptical gear 54, rotor shaft 90 and main shaft 51. FIG. 2 clearly shows that it has cylindrical tongue 32 on its internal transverse surface i.e., facing the working chamber 140, having identical diameter as that of the internal hollow of the shell 20. This same cylindrical tongue 32 serves as the end plate of the working chamber 140. It also facilitates the mounting and alignment of the shell 20 during assembly.

Through the axis of this cylindrical tongue 32 is a longitudinal hole 33 with gas seal 34 for dynamic sealing and anti-friction bearing 35 for journalling the rotor shaft 90. Below this is another longitudinal hole 36 through which the main shaft 51 passes from the shell hole 22.

The gear box body 30 has longitudinal holes 37, 37, etc. and threaded blind holes 39, 39, etc. along its periphery where the stud bolts 6, 6, etc. pass through and are screwed, respectively. It has also two countersunk holes 38, 38 in the transverse face of the oblong recess 31 for installing the countersunk Allen screw 5', 5'.

Gear box cover plate

Figure 6:
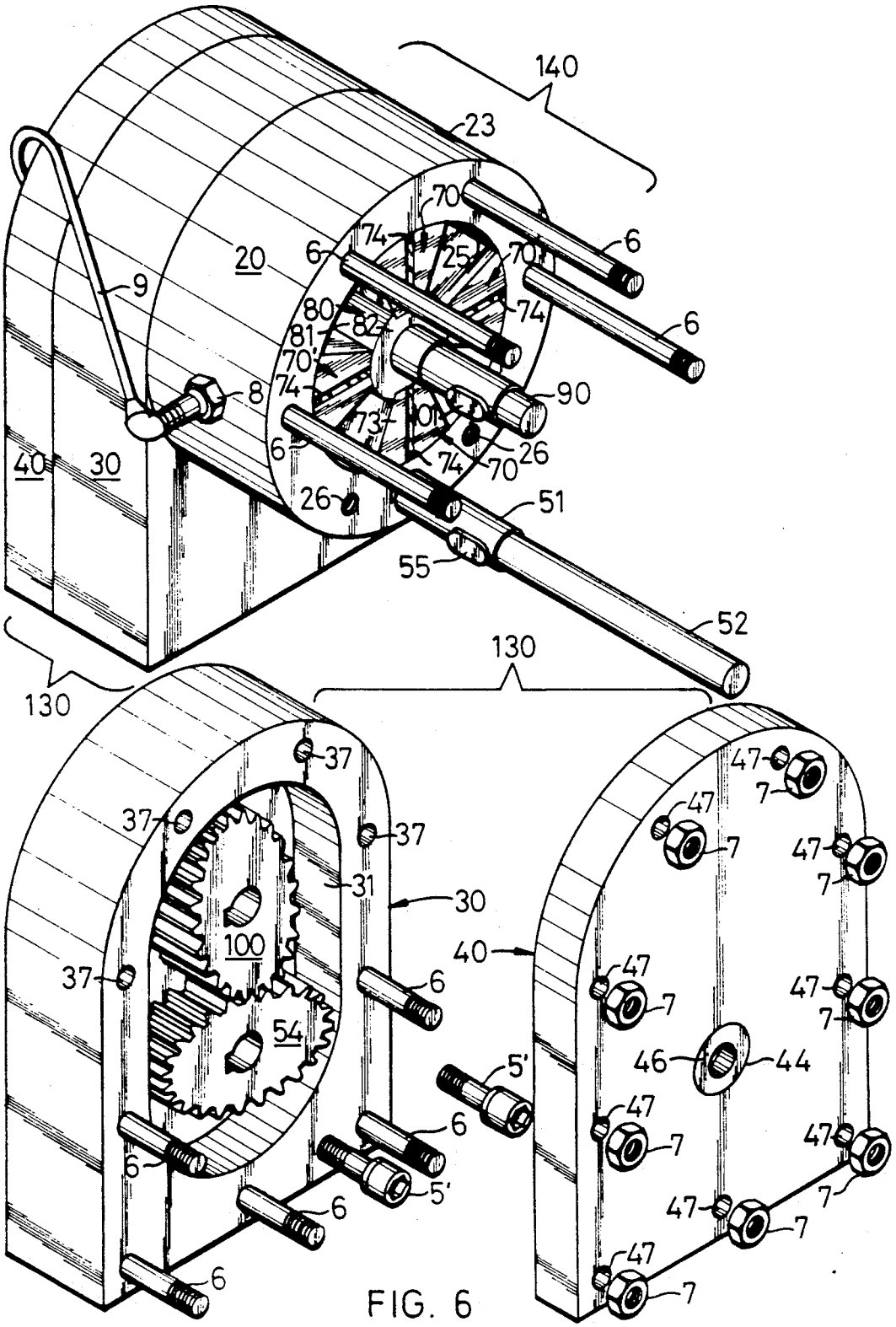
FIG. 6 is the isometric drawing of the concentric rotary internal combustion engine with the front gear box and working chamber opened up to show their internal features.

It is clear from FIGS. 1, 6 and 7 that the gear box cover plate 40 has the same transverse outline as the gear box body 30, however, the former has no recess and is about half the latter's thickness. On its inner transverse side, i.e., facing the gears 54, 100, the gear box cover plate 40 has an oblong tongue 41 assuming the shape and transverse dimensions of the oblong recess 31 of the gear box body 30. This oblong tongue 41 shown in FIG. 2 facilitates the mounting and alignment of the gear box body 30.

This oblong tongue 41 is constructed with two identical semi-circles and their tangent lines. The centers of the semi-circles are apart vertically by the distance between the axes of the rotors 60, 60' and the main shaft 51 because said axes pass through these centers of the semi-circles.

Through the center of said top semi-circle is a blind longitudinal hole 42 coaxial with the hole 33 of the gear box body 30 and the rotors 60, 60'. It has an anti-friction bearing 43 for journalling the rotor shaft 90.

Through the center of said bottom semi-circle is a longitudinal hole 44 coaxial with the hole 36 of the gear box body 30 and the main shaft 51, with an anti-friction bearing 45 for journalling the main shaft 51 and an oil seal 46 for dynamic sealing.

The gear box cover plate 40 has also longitudinal holes 47, 47, etc. along its periphery through which the stud bolts 6, 6, etc. pass.

Intermediate Elliptical Gears and Main Shaft Assembly

The intermediate elliptical gears and main shaft assembly 50 or its parts can be seen in FIGS. 2, 3, 4, 5, 6 and 8.

The main shaft 51 passes from end to end of the engine 120 as demonstrated in FIG. 2. It passes through the holes 36, 36 of the gear box bodies 30, 30 and the hole 22 of the shell 20, and is journalled for rotation in the holes 44, 44 of the gear box cover plates 40, 40 through anti-friction bearings 45, 45 force fitted therein.

The front end 52 of the main shaft 51 is connected to the driven machine or machines as well as to the contrivance for starting the engine 120. Its rear end 53 is a square cam operating the contact breaker (not shown in the drawings) for proper ignition timing.

The two identical intermediate elliptical gears 54, 54, are mounted and secured to the main shaft 51 with keys 55, 55 at points corresponding to the locations of the gear boxes 130, 130, where they enmesh with the rotor elliptical gears 100, 100.

Rotor

FIGS. 2, 4, 5, 6 and 9 show the tow rotors 60, 60' and their spacer 110. Since the two rotors 60, 60' are identical, it is sufficient to discuss only one of them.

Each rotor 60 consists of a pair of diametrically opposing and identical arcuate vanes 70, 70, a rotor cylinder 80, a rotor shaft 90 outwardly and coaxially projecting from said rotor cylinder 80, and an elliptical gear 100 secured to the said rotor shaft 90 with key 101.

The rotor elliptical gear 100 is identical with the intermediate elliptical gear 54 with which it is enmeshed inside the gear box 130.

For stability, the rotor shaft 90 is journalled for rotation in both gear box body 30 and gear box cover plate 40 through anti-friction bearings 35, 43 in their respective holes 33, 42.

Each vane 70 is arcuate in shape having inner and outer circumferential surfaces 72, 71. Its outer circumferential convex surface 71 has a radius of curvature virtually equal to the radius of the internal circumferential surface 25 of the shell 20. Its inner circumferential concave surface 72 has a radius of curvature virtually equal to the radius of the circumferential surface 81 of the rotor cylinder 80. Its transverse surfaces 73, 73 flushes with the outer transverse surfaces 82, 82 of both rotor cylinders 80, 80' because they are in parallel planes normal to the axis of the rotors 60, 60'. The length of each vane 70 is equal to the effective length of the assembly of the two rotor cylinders 80, 80' and their axial spacer 110. This length is virtually equal but a stifle less than the axial length of the working chamber 140.

For dynamic sealing and to minimize friction, each vane 70 is provided with groove 74 in its inner and outer circumferential surfaces 72, 71 and transverse surfaces 73, 73 running perpendicular to the direction of its travel.

The pair of diametrically opposing identical arcuate vanes 70, 70 are mounted and fixed to the rotor cylinder 80 with countersunk Allen screws 5', 5'. For this purpose, each vane 70 has wedge-shaped base 75 inwardly projecting from one side of its inner circumferential surface 72, and a countersunk hole 76 transversely passing through this said base 75; while the rotor cylinder 80 has two diametrically opposing wedge-shaped longitudinal grooves 85, 85 identical in shape and size to the wedge-shaped base 75 of the vane 70, as well as a threaded diametrical hole 86 coaxial with the countersunk holes 76, 76 of the pair of vanes 70, 70.

The two rotors 60, 60' are rotatably joined by the spacer 110 made of graphite or the like serving as seal and bearing at the same time. It has a disc plate 111 serving as thrust bearing for the inner transverse surfaces 83, 83 of the rotor cylinders 80, 80'; and two coaxial journals 112, 112 at its opposite transverse sides serving as radial bearings for the cylindrical recesses 84, 84 in the inner transverse surfaces 83, 83 of the rotor cylinders 80, 80'. Their axial spacer 110 serves as seal because its good bearing quality makes minimum working clearance between rubbing parts possible, thus controlling the leakage of combustion media from one combustion chamber 1, 2, 3 or 4 to another.

BASIC ENGINE ASSEMBLY

When the various parts of the stator 10, rotors 60, 60' and their spacer 110, and the intermediate elliptical gears and main shaft assembly 50 are assembled and bolted according to the disposition of the parts in FIGS. 2, 3, 4, 5 and 6, two gear boxes 130, 130 and the working chamber 140 inbetween them are formed.

The rotors 60, 60' and their spacer 110 are mounted inside the working chamber 140 such that the rotor cylinders 80, 80' and their axial spacer 110 are rotatably journalled between the inner circumferential concave surfaces 72, 72, 72, 72 of the vanes 70, 70, 70', 70'; the outer circumferential convex surfaces 71, 71, 71, 71 of the vanes 70, 70, 70', 70' are journalled for rotation inside the right circular cylindrical hollow 25 of the shell 20; the transverse surfaces 73, 73, etc. of the vanes 70, 70, 70', 70' and the outer transverse surfaces 82, 82 of the rotor cylinders 80, 80' are in sealing sliding engagement with the internal surfaces of the transverse end plates 32, 32; and the rotor shafts 90, 90 are journalled for rotation in the gear box bodies 30, 30 through their holes 33, 33 with anti-friction bearings 35, 35 as well as in the gear box cover plates 40, 40 through their blind holes 42, 42 with anti-friction bearings 43, 43.

ANNULAR CYLINDRICAL SPACE

Taking for granted the existence of the vanes 70, 70, 70', 70' in FIGS. 4 and 5, there results the working chamber 140 which is an annular cylindrical space bounded by the circumferential surfaces 81, 81 of the rotor cylinders 80, 80', the circumferential surface of the disc 111 of the axial spacer 110, the inner circumferential surface 25 of the shell 20 and the internal surfaces of the transverse end plates 32, 32. Viewed as an integral unit, this assembly corresponds to the cylinder block of the convention piston-cylinder reciprocating internal combustion engine.

To seal this annular cylindrical space of the concentric rotary internal combustion engine 120 from the gear boxes 130, 130, gas seals 34, 34 made of graphite or the like designed for high temperature and pressure applications are installed in holes 33, 33 between the rotor shafts 90, 90 and the gear box bodies 30, 30.

FOUR COMBUSTION CHAMBERS

With the incorporation of the vanes 70, 70, 70', 70' in the said annular cylindrical working chamber 140, four variable volume-combustion chambers 1, 2, 3, 4 are created.

To seal these combustion chambers 1, 2, 3, 4 from each other, the vanes 70, 70, 70', 70' have grooves 74, 74, 74, 74 in their rubbing parts in contact with the shell's internal circumferential surface 25, rotor cylinders' circumferential surfaces 81, 81 and the internal surfaces of the transverse end plates 32, 32, running perpendicular to the direction of the travel of said vanes 70, 70, 70', 70'.

During normal operation, the grooves 74, 74, 74, 74 of the vanes 70, 70, 70', 70' contain hot gases offering resistance to passage of combustion media across working clearances between rubbing parts.

ANALOG OF THE OPPOSED PISTONS-CYLINDER MECHANISM

The opposed pistons-cylinder mechanism of the conventional reciprocating internal combustion engine is duplicated in the concentric rotary internal combustion engine 120. The shell 20, rotor cylinders 80, 80' and their axial spacer 110, and the two transverse end plates 32, 32 serve as the cylinder block; while the annular cavity or working chamber 140 that they bound and define functions as the cylinder. The four vanes 70, 70, 70', 70' dividing the working chamber 140 into four variable volume-arcuate combustion chambers 1, 2, 3, 4 correspond to the pistons. Each set of adjacent vanes 70, 70' function as opposed pistons, and the combustion chamber 1, 2, 3, or 4 that they enclose corresponds to the combustion chamber common to both pistons in the opposed pistons-cylinder engine.

In this regard, each combustion chamber 1, 2, 3 or 4 can be regarded as equivalent to a cylinder with two opposed pistons facing each other, having the space between them as their common combustion chamber. So, there is no cylinder head because an empty space stands in its stead. The spark plug 8 and ports 23, 24 normally located in the cylinder head are in the shell 20.

Compression occurs when adjacent vanes 70, 70' approach towards each other because the combustion chamber 1, 2, 3 or 4 that they bound shrinks. Conversely, expansion happens when adjacent vanes 70, 70' run away from each other because the combustion chamber 1, 2, 3, or 4 that they enclose enlarges.

Figure 11:
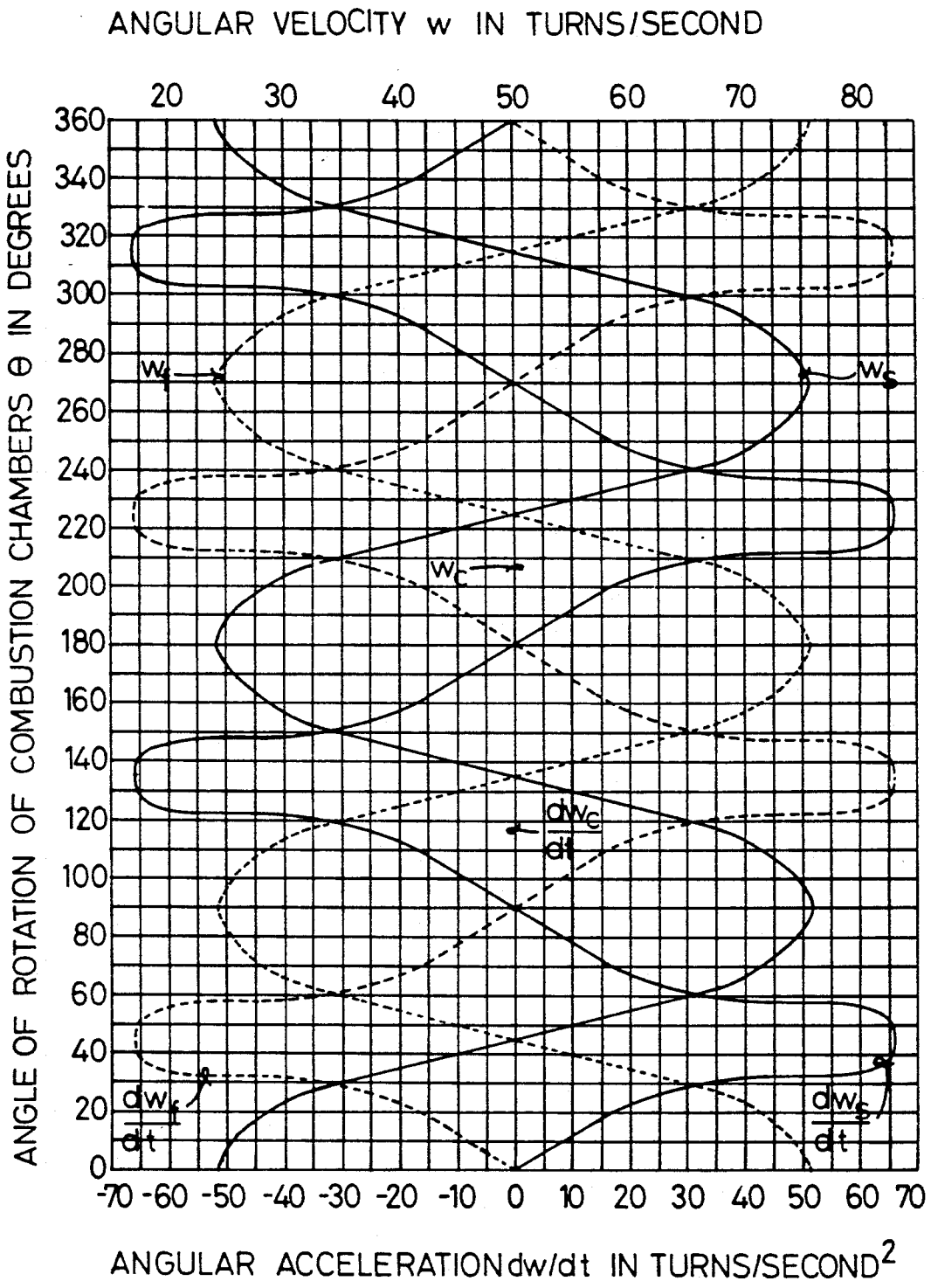
FIG. 11 is the curves of angular velocity and angular acceleration of the first rotor (f), second rotor (s) and combustion chambers (c) of the concentric rotary internal combustion engine as functions of angle of rotation of the combustion chambers assumed to rotate at constant angular velocity of 50 turns per second (FIG. 11 applies also to concentric rotary external combustion engines, hydraulic motor, liquid pump, vacuum pump and compressor when "variable-volume" is substituted for "combustion" in "combustion chambers")

Allowing the combustion chambers 1, 2, 3, 4 revolve about their common axis of turning at constant angular velocity $w_c$, say 50 turns/second as in FIG. 11, each of them symmetrically enlarges from minimum volume (10° angular space as read from FIG. 12) to maximum volume (76.8° angular space as read from FIG. 12) when passing by the inlet 23 during the intake phase, and when passing between the spark plug 8 and the outlet 24 during the power phase; as well as symmetrically shrinks from maximum volume to minimum volume when passing by the outlet 24 during the exhaust phase, and when passing between the inlet 23 and the spark plug 8 during the compression phase. When combustion chambers 1, 2, 3, 4 revolve at constant angular velocity $w_c$, the first and second rotors 60', 60 always travel at varying angular velocities $w_f$, $w_s$. Opposite vanes 70, 70 (or 70', 70') have identical angular velocity $w_s$ and angular acceleration $dw_s/dt$ because they are parts of the same rotor 60 (or 60'). Whereas, adjacent vanes 70, 70' revolve with angular velocities $w_s$, $w_f$ having equal absolute values of their differences from the angular velocity $w_c$ of the combustion chambers 1, 2, 3, 4; and at varying angular accelerations $dw_s/dt$, $dw_f/dt$ equal in magnitude but opposite in direction. Please see FIG. 11 for the case when angular velocity $w_c$ of combustion chambers 1, 2, 3, 4 equals 50 turns/-second.

During the compression phase, both backward and reactive (i.e., forward) forces upon the trailing and leading vanes 70', 70 of the combustion chamber 1 have the same magnitude and directional sense, and consequently, additive in absorbing mechanical power. In the same fashion during the power phase, both forward and reactive (i.e., backward) forces upon the leading and trailing vanes 70, 70' of the combustion chamber 1 have the same magnitude and directional sense and so, additive in producing positive mechanical power.

The smooth and effective operation of this analog of the opposed pistons-cylinder mechanism in the invention is enhanced by the concentricity of the assembly of rotors 60, 60' and their axial spacer 110 inside the working chamber 140, as well as the presence of hot gases in the grooves 74, 74, 74, 74 of the rubbing parts of the vanes 70, 70, 70', 70'.

Working clearance small enough for minimal leakage of combustion media from one combustion chamber 1, 2, 3, or 4 to another, and big enough for minimal friction between rubbing parts can be easily adopted because said rubbing parts are concentric and coaxial.

The hot gases in the grooves 74, 74, 74, 74 of the vanes 70, 70, 70', 70' works as piston rings and lubricant between rubbing parts. The hot gases seals because by virtue of its mass, it occupies the space in the grooves 74, 74, 74, 74 between rubbing parts offering resistance to passage of combustion media. The hot gases trapped in said grooves 74, 74, 74, 74 of the vanes 70, 70, 70', 70' also minimizes friction and centralizes the rotors 60, 60' and their axial spacer 110 inside the working chamber 140, because by virtue of its mass and pressure, the hot gases tends to separate the rubbing parts ensuring virtually equal clearances between said rubbing parts during normal operation.

PROPORTIONAL DIMENSIONS

To give physical embodiment to the invention without limiting its scope in order to facilitate its understanding and have basis of the following kinematic analysis, the invention is given basic physical dimensions and 7.68 compression ratio.

The following description is specific for the concentric rotary internal combustion engine 120, but applies as well to the concentric rotary external combustion engines, hydraulic motor, liquid pump, vacuum pump and compressor if the combustion chambers 1, 2, 3, 4 are renamed as variable-volume chambers, the spark plug 8 is removed, and an identical set of ports 23', 24' are provided in the shell 20 as mirror images of the existing and first set of ports 23, 24. Please see FIG. 15.

To achieve 7.68:1 compression ratio, the outer circumferential thickness of the vane 70, the common diameter of inlet 23 and outlet 24 must be equal with each other as measured on the internal circumferential surface 25 of the shell 20. Expressed as intercepted angle about the axis of the working chamber 140, this dimension is 46.6° or approximately 360° divided by the compression ratio of 7.68:1. With 90° stroke or a quarter of complete revolution, the minimum and maximum volumes of the combustion chamber 1, 2, 3, 4 are 10° and 76.8° , respectively.

Thus, in one revolution of each combustion chamber 1, 2, 3 or 4, it performs one complete four-stroke-Otto-cycle because its volume enlarges to maximum size of 76.8° and shrinks to minimum size of 10° twice. This is in contrast to two revolutions of the conventional engine. Clearly, the concentric rotary internal combustion engine is equivalent to an eight cylinder four stroke piston-cylinder engine of the same combustion chamber displacement and compression ratio because both perform eight power strokes for every two revolutions.

KINEMATIC ANALYSIS

Figure 10:
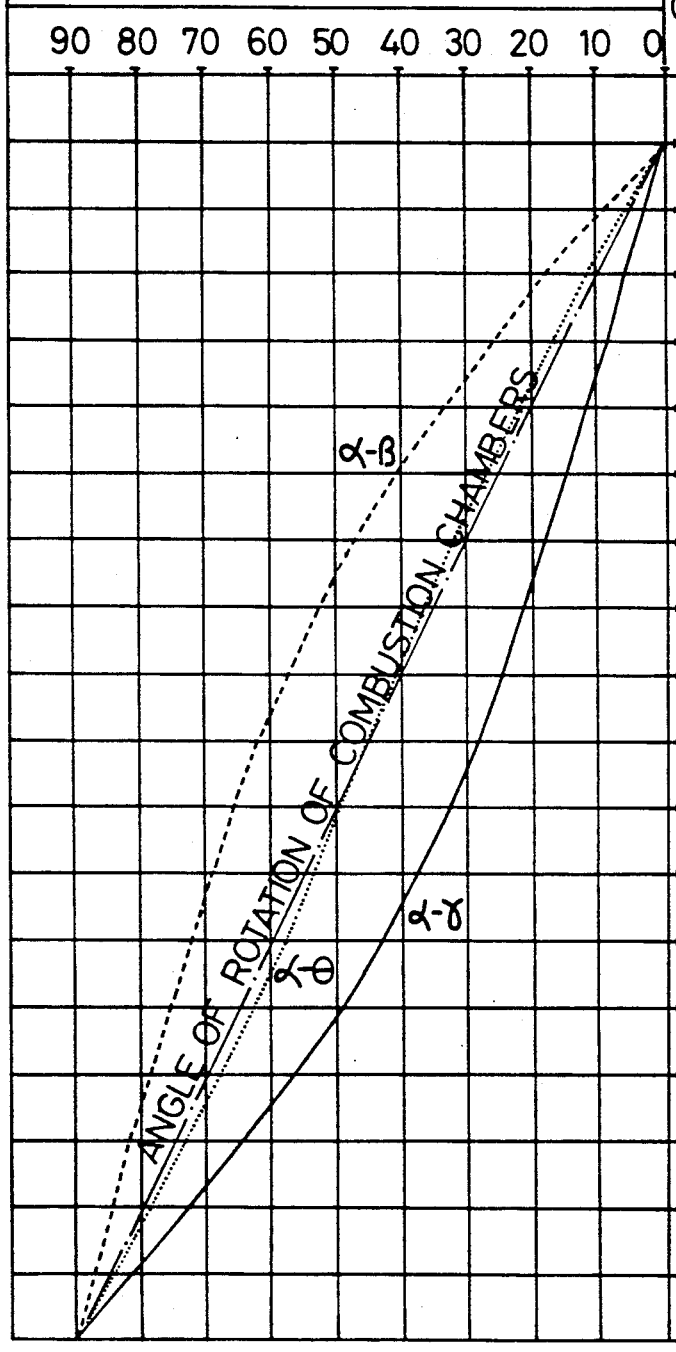
FIG. 10 is the curves of angles of rotation of rotors and combustion chambers of the concentric rotary internal combustion engine as functions of angle rotation of intermediate gears (FIG. 10 applies also to concentric rotary external combustion engines, hydraulic motor, liquid pump, vacuum pump and compressor when "variable-volume" is substituted for "combustion" in "combustion chambers")

The straight diagonal line in FIG. 10 describes the rotary movement of the main shaft 51 and intermediate gears 54, 54. The curve $\alpha$-$\theta$ made up of dots describes the relationship between the angle of rotation $\theta$ of the combustion chambers 1, 2, 3, 4 and the angle of rotation $\alpha$ of the intermediate elliptical gears 54, 54. The two curves are virtually identical and for practical purpose, the combustion chambers 1, 2, 3, 4 can be considered to revolve at the same angular velocity and angular acceleration as the intermediate elliptical gears 54, 54 rotate.

However, their minute difference means either a complex or simple analysis of the kinematics of the rotors 60, 60' depending on whether it is taken into consideration or disregarded. Therefore, to simplify the kinematic analysis with sufficient accuracy. FIG. 11 is constructed under the domain of the angle of rotation $\theta$ of the combustion chambers 1, 2, 3, 4 instead of the usual angle of rotation of the intermediate elliptical gears 54, 54, in order to show clearly the symmetrical movements of the rotors 60, 60' and the vanes 70, 70, 70', 70' with respect to the centers of the combustion chambers 1, 2, 3, 4.

However, in FIGS. 10, 12, 13 and 14, the rotation $\alpha$ of the intermediate elliptical gears 54, 54 is utilized as known variable because it is the output motion of the concentric rotary internal combustion engine 120.

Travel Distance, Angular Velocity & Angular Acceleration

Imagine a video camera revolving about the axis of the rotors 60, 60' at the same constant angular velocity $w_c$ of 50 turns/second and angular acceleration $dw_c/dr$ of 0 turn/second$^2$ identical to the angular velocity and acceleration of the combustion chambers 1, 2, 3, 4. If one of the four combustion chambers 1, 2, 3, 4 is focused in the video, it will be shown to stay in the center of the video screen as if it were stationary. However, it will be seen to symmetrically enlarge and shrink. This phenomenon becomes clear after studying FIG. 10, where it can be gleaned that the center of each combustion chamber 1, 2, 3 or 4 is always in the middle between its leading and trailing vanes 70, 70' (applicable for combustion chambers 1 and 3). In other words, its angle of rotation $\theta$ is always the average of the sum of the angles of rotation of its leading and trailing vanes 70, 70'. The formula applicable for combustion chamber 1 is $$\theta=\tfrac{1}{2}(\beta+\gamma)$$

where $\beta$ is rotation of first rotor 60' and trailing vane 70' while $\gamma$ is rotation of second rotor 60 and leading vane 70.

As the combustion chamber 1 enlarges as viewed in said video screen, its leading vane 70 advances forward while its trailing vane 70' recedes, their relative instantaneous distances of travel, angular velocities and angular accelerations being the same in magnitude but opposite in direction with respect to the center of combustion chamber 1. In their revolution as viewed externally of the video camera, the absolute differences of the angular velocities $w_s$, $w_f$ of the leading and trailing vanes 70, 70' from the angular velocity $w_c$ of combustion chamber 1 are always equal. This relationship is expressed mathematically as follows:

$$|w_c-w_s|=|w_c-w_f|$$

In this regard, both the leading and trailing vanes 70, 70' have equal roles in absorbing and producing mechanical power during the compression and power phases inside combustion chamber 1, respectively.

The distance of travel (expressed as angular rotation in degrees) of each vane 70 or 70' or rotor 60 or 60' can be read off from FIG. 10, while the angular velocities $w_f$, $w_s$ as well as angular accelerations $dw_f/dt$, $dw_s/dt$ of the first and second rotors 60', 60 can be determined from FIG. 11 where it is arbitrarily assumed that the combustion chambers 1, 2, 3, 4 revolve at constant angular velocity $w_c$ of 50 turns/second and angular acceleration $dw_c/dt$ of 0 turn/second$^2$.

It is clear in the curves that there are two cycles per rotation. In the first and third cycles, the angular velocity $w_s$ of the leading vane 70 is greater than the angular velocity $w_c$ of the combustion chamber 1, the angular velocity $w_f$ of the trailing vane 70' is less than the angular velocity $w_c$ of said combustion chamber 1, the angular acceleration $dw_s/dt$ of the leading blade 70 progressively increases from minimum to maximum, and the angular acceleration $dw_f/dt$ of the trailing vane 70' progressively decreases from maximum to minimum. The reverse happens in the second and fourth cycles. Consequently, in each rotation of the rotors 60, 60', the combustion chambers 1, 2, 3, 4 enlarge and shrink twice. During the enlarging of the volume of the combustion chamber 1, the leading vane 70 revolves at varying angular velocity $w_s$ greater than the angular velocity $w_c$ of the combustion chamber 1, while the trailing vane 70' revolves at varying angular velocity $w_f$ less than the angular velocity $w_c$ of said combustion chamber 1. Whereas, during its shrinking, the leading vane 70 revolves at varying angular velocity $w_s$ less than the angular velocity $w_c$ of the combustion chamber 1, while the trailing vane 70' revolves at varying angular velocity $w_f$ greater than the angular velocity $w_c$ of said combustion chamber 1. In all cases, the angular accelerations $dw_s/dt$, $dw_f/dt$ of the adjacent vanes 70, 70' are always equal in magnitude but opposite in direction.

TORSIONAL MOMENTS

The rotors 60, 60' use up and produce centrifugal, accelerating, compression and expansion forces. To make certain that the engine will continuously operate, it is necessary to have a net force with the same directional sense as the rotation of the rotors 60, 60'. Forces have the same directional sense if they are additive, and vice versa.

The centrifugal force neither add nor subtract from the effective power output of the concentric rotary internal combustion engine 120 because it is balanced and directed normal to the direction of travel of the vanes 70, 70, 70', 70' but it assists in achieving stable running of the rotors 60, 60' for its flywheel effect.

Instead of forces, torsional moments are determined and used in the following power analysis because it readily converts to mechanical power given the rotative speed.

The accelerating moment M is the product of the mass moment of inertia I and the angular acceleration dw/dt:

$$M=I\,dw/dt$$

The mass moment of inertia I of the rotors 60, 60' about their common axis is the sum of the products of their mass elements and the squares of the distances of their centers from said axis. On the other hand, the angular acceleration $dw_f/dt$ of the first rotor 60' and the angular acceleration $dw_s/dt$ of the second rotor 60 can be read off from FIG. 11. In case the angular velocity $w_c$ of the combustion chambers 1, 2, 3, 4 differs from 50 turns/second, it is necessary to multiply the data by $w_c/50$.

During the compression phase, the combustion chamber 1 reduces in volume when the leading vane 70 and the trailing vane 70' approach towards each other from opposite directions. The increasing pressure resulting from the compression of the mixture of air and fuel offers resistance to the approach of the adjacent vanes 70, 70' towards the center of the combustion chamber 1. While heat is released during the vaporization of fuel, heat from the hot metal parts of the engine 120 is transferred by air convection to the combustion media. The process is polytropic. Since the polytropic formula for pressure as a function of volume is difficult to ascertain, the compression of the combustion media is assumed to be isentropic to simplify the computation. Pressure is inversely related with volume apparently following the following formula:

$$P=p(v/V)^{1.4}=p(a/A)^{1.4}$$

where P, V and A are final absolute pressure, volume and angular space of combustion chamber 1, respectively, while p, v and a are its initial absolute pressure, volume and angular space, respectively.

The resulting torque or torsional moment $M_c$ during compression phase is the product of absolute pressure and volume. It is formulated below as a function of angular space A, where q, W, R, r and 360 are defined below under the heading "INTERNAL COMBUSTION PROCESS".

$$\begin{aligned} M_c &= PV \\ &= [p(a/A)^{1.4}] \times [\ WA(R^2 - r^2)/360°] \\ &= [\ Wpa^{1.4}(R^2 - r^2)/360] \times A^{-0.4}. \end{aligned}$$

During the power phase, the combustion chamber 1 increases in volume when the leading vane 70 and trailing vane 70' move away from each other towards opposite directions reckoned with respect to and from the center of said combustion chamber 1. The pressure resulting from the combustion of fuel by air and the heating up of the gases reinforces this separation of the adjacent vanes 70, 70'. Pressure is again assumed to follow the isentropic formula:

$$P=p(v/V)^{1.4}=p(a/A)^{1.4}$$

where the nomenclature is the same as before.

The resulting torque or torsional moment $M_e$ during expansion or power phase can be determined using the same formula for the compression phase, as follows:

$$M_e=[qWa^{1.4}(R^2-r^2)/360]\times A^{-0.4}$$

where the nomenclature is the same as before.

ANGULAR SPACES & PRESSURES OF COMBUSTION CHAMBER 1

Ellipses having concentricity of 8.174 centimeters and vertex radii of 17.241 centimeters and 3.364 centimeters are constructed to simulate the rotational movements of the intermediate elliptical gears 54, 54, the rotors 60, 60' and the combustion chambers 1, 2, 3, 4. By careful measurements at various arrangements of the rotors 60, 60' and intermediate gears 54, 54 at every 5° increment of the angle of rotation $\theta$ of the combustion chamber 1 and the angle of rotation $\alpha$ of the intermediate elliptical gears 54, 54, fairly accurate empirical data are gathered describing the rotational movements of the rotors 60, 60', combustion chambers 1, 2, 3, 4 and intermediate gears 54, 54. The angular space A of the combustion chamber 1 at any instance in the rotation of the intermediate gears 54, 54 can be read off from FIG. 12 which is also applicable for combustion chambers 2, 3 and 4 if the vertical scale is moved upward by 90°, 180° and 270°, respectively.

Figure 12:
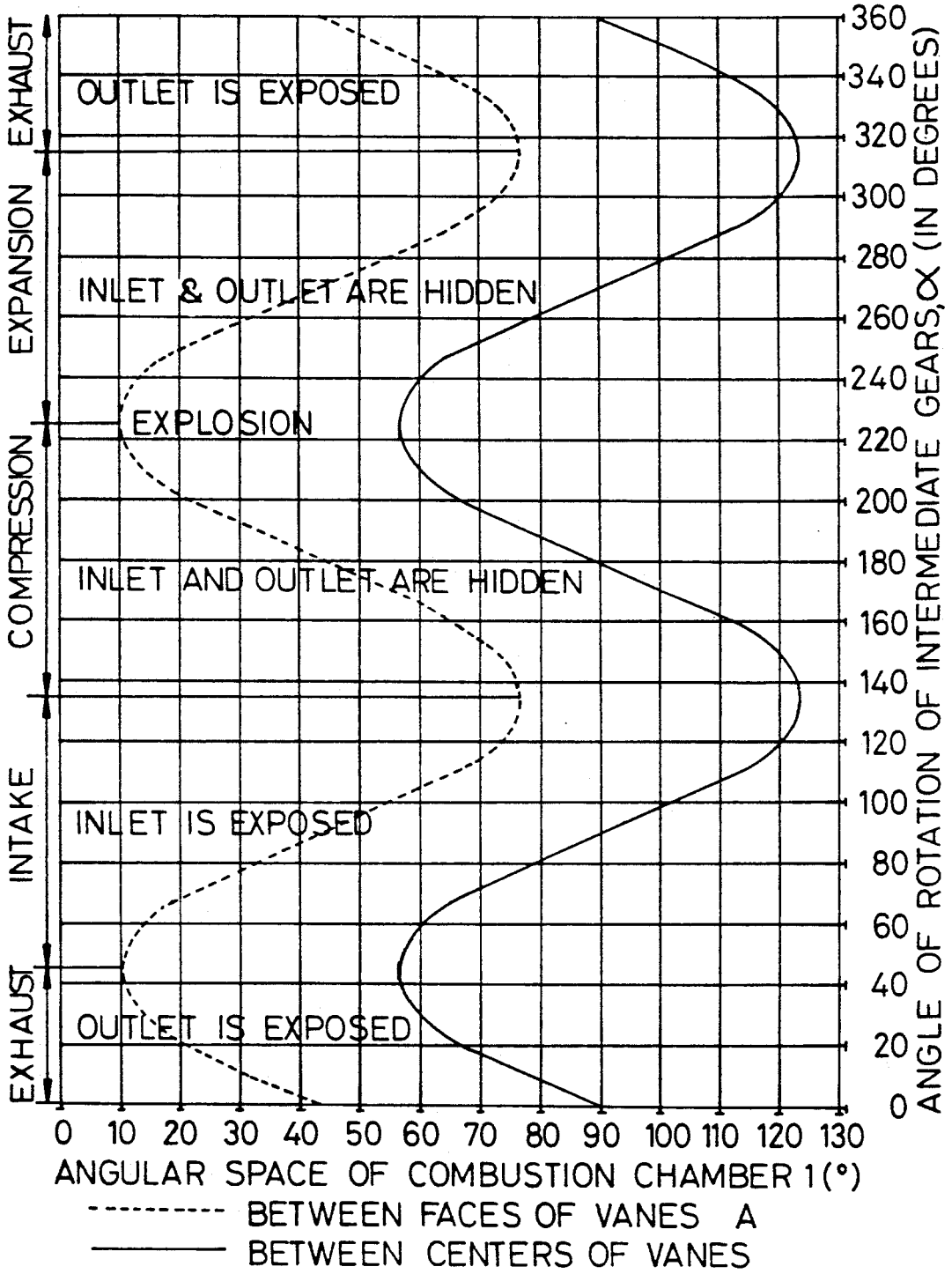
FIG. 12 is the curves of angular space of combustion chamber 1 of the concentric rotary internal combustion engine as a function of angle of rotation of intermediate gears (FIG. 12 applies also to concentric rotary external combustion engines, hydraulic motor, liquid pump, vacuum pump and compressor when "vairable-volume" is substituted for "combustion" in "combustion chamber 1")
Figure 13:
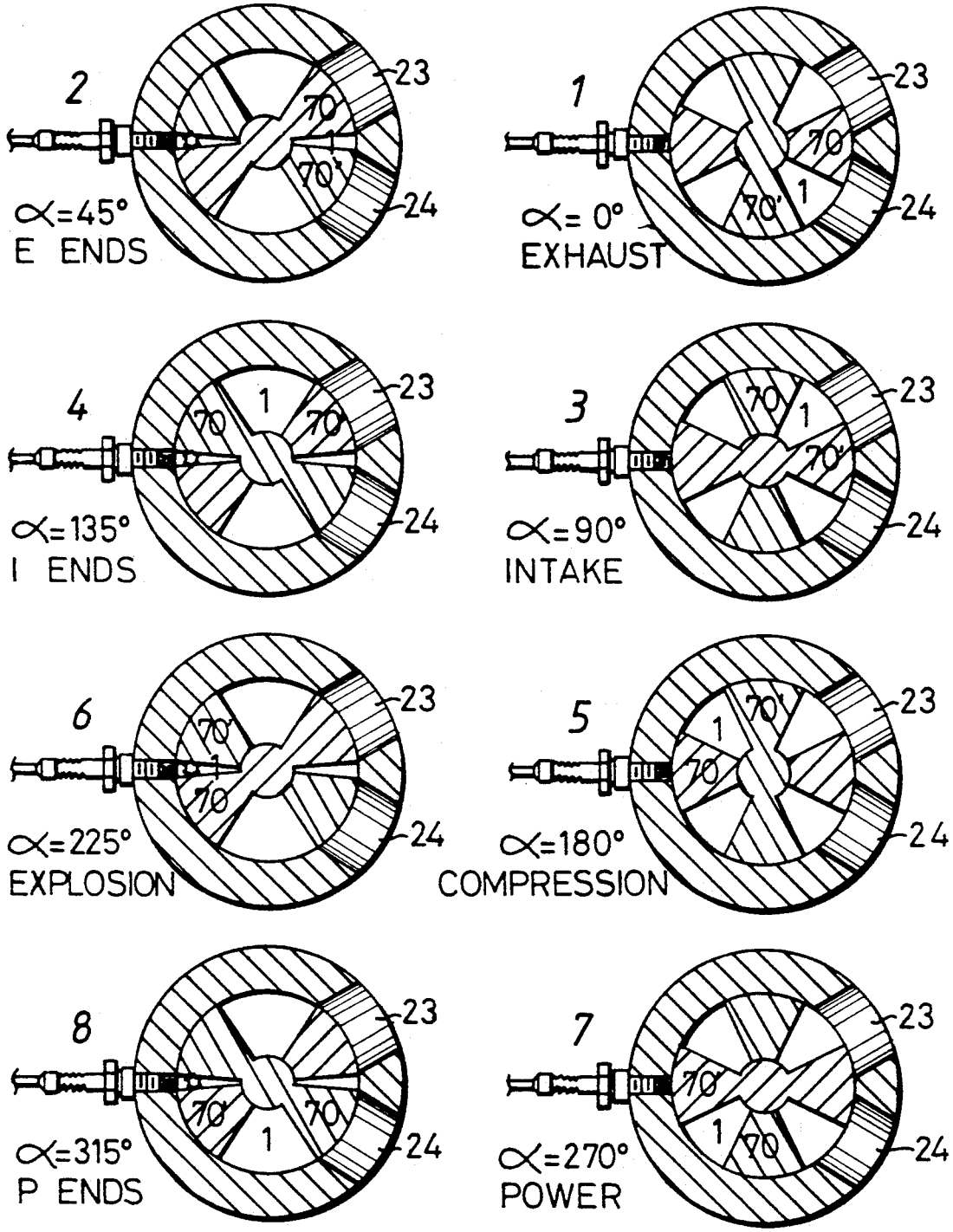
FIG. 13 is the transverse sections of the working chamber of the concentric rotary internal combustion engine at 45° intervals of angle of rotation of intermediate gears showing the sequential exposure and blockage of the ports and phrases of the Otto cycle for combustion chamber 1.

FIG. 12 also shows the various phases in the four stroke Otto internal combustion cycle as periods within one rotation of the intermediate gears 54, 54 and one revolution of the combustion chamber 1. It also shows when the inlet 23 and outlet 24 are exposed and hidden as viewed from within the combustion chamber 1.

It is determined from FIG. 12 that intake of mixture of air and fuel occurs from $\alpha=45°$ to $\alpha=135°$. Since the inlet 23 is exposed throughout the intake phase, the combustion chamber 1 communicates with the infinite atmosphere having an absolute pressure of 1 bar. Consequently, as it expands and draws in fuel-air mixture via the carburetor, atmospheric pressure is maintained throughout.

During the compression phase from $\alpha=135°$ to $\alpha=225°$, the combustion chamber 1 is sealed, i.e., both ports 23, 24 are hidden from view. Consequently, as it compresses the combustion media without loss of heat, pressure escalates following the formula:

$$P=p(a/A)^{1.4}$$

TABLE 1

| TRAVEL OF INTERMEDIATE ELLIPTICAL GEARS | ANGULAR SPACE OF COMBUSTION CHAMBER 1 IN DEGREES | | | ABSOLUTE PRESSURE OF COMBUSTION CHAMBER IN BARS | |
|---|---|---|---|---|---|
| | a | A | $[a/A]^{1.4}$ | p | P |
| 135°-140° | 76.8 | 76.4 | 1.007 | 1.000 | 1.007 |
| 140°-145° | 76.4 | 75.1 | 1.024 | 1.007 | 1.031 |
| 145°-150° | 75.1 | 72.8 | 1.045 | 1.031 | 1.077 |
| 150°-155° | 72.8 | 69.6 | 1.065 | 1.077 | 1.147 |
| 155°-160° | 69.6 | 65.4 | 1.091 | 1.147 | 1.251 |
| 160°-165° | 65.4 | 60.5 | 1.115 | 1.251 | 1.395 |
| 165°-170° | 60.5 | 55.1 | 1.140 | 1.395 | 1.590 |
| 170°-175° | 55.1 | 49.3 | 1.168 | 1.590 | 1.857 |
| 175°-180° | 49.3 | 43.4 | 1.195 | 1.857 | 2.219 |
| 180°-185° | 43.4 | 37.5 | 1.227 | 2.219 | 2.723 |
| 185°-190° | 37.5 | 31.7 | 1.265 | 2.723 | 3.444 |
| 190°-195° | 31.7 | 26.3 | 1.299 | 3.444 | 4.474 |
| 195°-200° | 26.3 | 21.4 | 1.335 | 4.474 | 5.973 |
| 200°-205° | 21.4 | 17.2 | 1.358 | 5.973 | 8.111 |
| 205°-210° | 17.2 | 14.0 | 1.334 | 8.111 | 10.820 |
| 210°-215° | 14.0 | 11.7 | 1.286 | 10.820 | 13.915 |
| 215°-220° | 11.7 | 10.4 | 1.179 | 13.915 | 16.406 |
| 220°-225° | 10.4 | 10.0 | 1.056 | 16.406 | 17.325 |

The final pressure P of combustion chamber 1 is computed for each 5° travel of the intermediate elliptical gears 54, 54 during the compression phase using the formula:

$$P=p[a/A]^{1.4}$$

TABLE 2

| TRAVEL OF INTERMEDIATE ELLIPTICAL GEARS | ANGULAR SPACE OF COMBUSTION CHAMBER 1 IN DEGREES | | | ABSOLUTE PRESSURE OF COMBUSTION CHAMBER IN BARS | |
|---|---|---|---|---|---|
| | a | A | $[a/A]^{1.4}$ | p | P |
| 225° | 10.0 | 10.0 | Explosion | 17.325 | 27.442 |
| 225°-230° | 10.0 | 10.4 | 0.947 | 27.442 | 25.988 |
| 230°-235° | 10.4 | 11.7 | 0.848 | 25.988 | 22.038 |
| 235°-240° | 11.7 | 14.0 | 0.778 | 22.038 | 17.146 |
| 240°-245° | 14.0 | 17.2 | 0.750 | 17.146 | 12.860 |
| 245°-250° | 17.2 | 21.4 | 0.736 | 12.860 | 9.465 |
| 250°-255° | 21.4 | 26.3 | 0.749 | 9.465 | 7.089 |
| 255°-260° | 26.3 | 31.7 | 0.770 | 7.089 | 5.459 |
| 260°-265° | 31.7 | 37.5 | 0.790 | 5.459 | 4.313 |
| 265°-270° | 37.5 | 43.4 | 0.815 | 4.313 | 3.515 |
| 270°-275° | 43.4 | 49.3 | 0.837 | 3.515 | 2.942 |
| 275°-280° | 49.3 | 55.1 | 0.856 | 2.942 | 2.518 |
| 280°-285° | 55.1 | 60.5 | 0.877 | 2.518 | 2.208 |
| 285°-290° | 60.5 | 65.4 | 0.897 | 2.208 | 1.981 |
| 290°-295° | 65.4 | 69.6 | 0.917 | 1.981 | 1.817 |
| 295°-300° | 69.6 | 72.8 | 0.939 | 1.817 | 1.706 |
| 300°-305° | 72.8 | 75.1 | 0.957 | 1.706 | 1.633 |
| 305°-310° | 75.1 | 76.4 | 0.976 | 1.633 | 1.594 |
| 310°-315° | 76.4 | 76.8 | 0.993 | 1.594 | 1.583 |

The final pressure P of combustion chamber 1 is computed for each 5° travel of the intermediate elliptical gears 54, 54 during the power phase using the formula:

$$P=p[a/A]^{1.4}$$

where the nomenclature is the same as before.

Table 1 is constructed using the above formula. It shows the angular space and absolute pressure at various angular rotations of the intermediate elliptical gears 54, 54.

Immediately after compression, the plug 8 sparks the ignition of the fully compressed fuel-air mixture. The final absolute pressure of 17.325 bars during the compression phase suddenly increases to 27.442 bars.

From $\alpha=225°$ to $\alpha=315°$, the combustion chamber 1 enlarges without loss of entropy. Pressure decreases according to the same relationship with angular space as in the compression phase. The absolute pressures and angular space of the combustion chamber 1 at 5° increments of the rotation of the elliptical gears 54, 54 are presented in Table 2. From a maximum absolute pressure of 27.442 bars during explosion, the absolute pressure progressively reduces to 1½ bars at the start of exhaust phase.

From $\alpha=315°$ to $\alpha=45°$ or 405°, the outlet 24 is exposed, the combustion chamber 1 is shrinking, and the by-products of combustion are leaving for the atmosphere. Since the combustion chamber 1 is communicating with the atmosphere and the exhaust discharge rate is fast and continuous, the final absolute pressure during the power phase of 1½ bars is maintained throughout the exhaust phase.

INTERNAL COMBUSTION PROCESS

FIG. 12 demonstrates that the angular space A of the combustion chamber 1 follows some sort of sinusoidal relationship with the rotation $\alpha$ of the intermediate elliptical gears 54, 54. For every rotation of the intermediate elliptical gears 54, 54 and one revolution of the combustion chamber 1, its volume alternately increases and decreases in volume two times. This is the ideal condition for the four stroke Otto internal combustion cycle.

Intake begins when $\alpha=45°$ and ends at $\alpha=135°$. During this period, the inlet 23 is exposed, the volume of combustion chamber 1 continuously enlarges, and the fuel-air mixture via the carburetor is drawn in due to the suction effect of enlarging. The combustion chamber 1 increases in volume from a 10° angular space to a 76.8° angular space. To translate the angular space A into volume, it must be multiplied by:

$$qW(R^2-r^2)/360°$$

where q is 3.1416, W is axial width of the combustion chamber 1, R is internal radius of shell 20, r is the radius of the rotor cylinders 60, 60' and 360° is the number of degrees in one revolution of the combustion chamber 1, W, R and r are in centimeters.

The intake of combustion media is an isothermal and isobaric process, the temperature and pressure being practically atmospheric. Hence in the P-V Diagram of FIG. 14, the intake phase is represented by a horizontal line a-b expressed mathematically as P=1 bar, absolute.

From $\alpha=135°$ to $\alpha=225°$, the combustion media is trapped inside the combustion chamber 1 because the ports 23, 24 are blocked; the volume of the combustion chamber 1 continuously shrinks; the air and fuel thoroughly mix into explosive gas which is compressed, heated up and pressurized; and the vanes 70, 70' defining the combustion chamber absorbs the compression torsional moment $M_c$ in order to sustain the compression process. The compression is a polytropic process, but in order to simplify the calculations, it is assumed to be isentropic. This is reflected by the curve b-c in FIG. 14.

Figure 14:
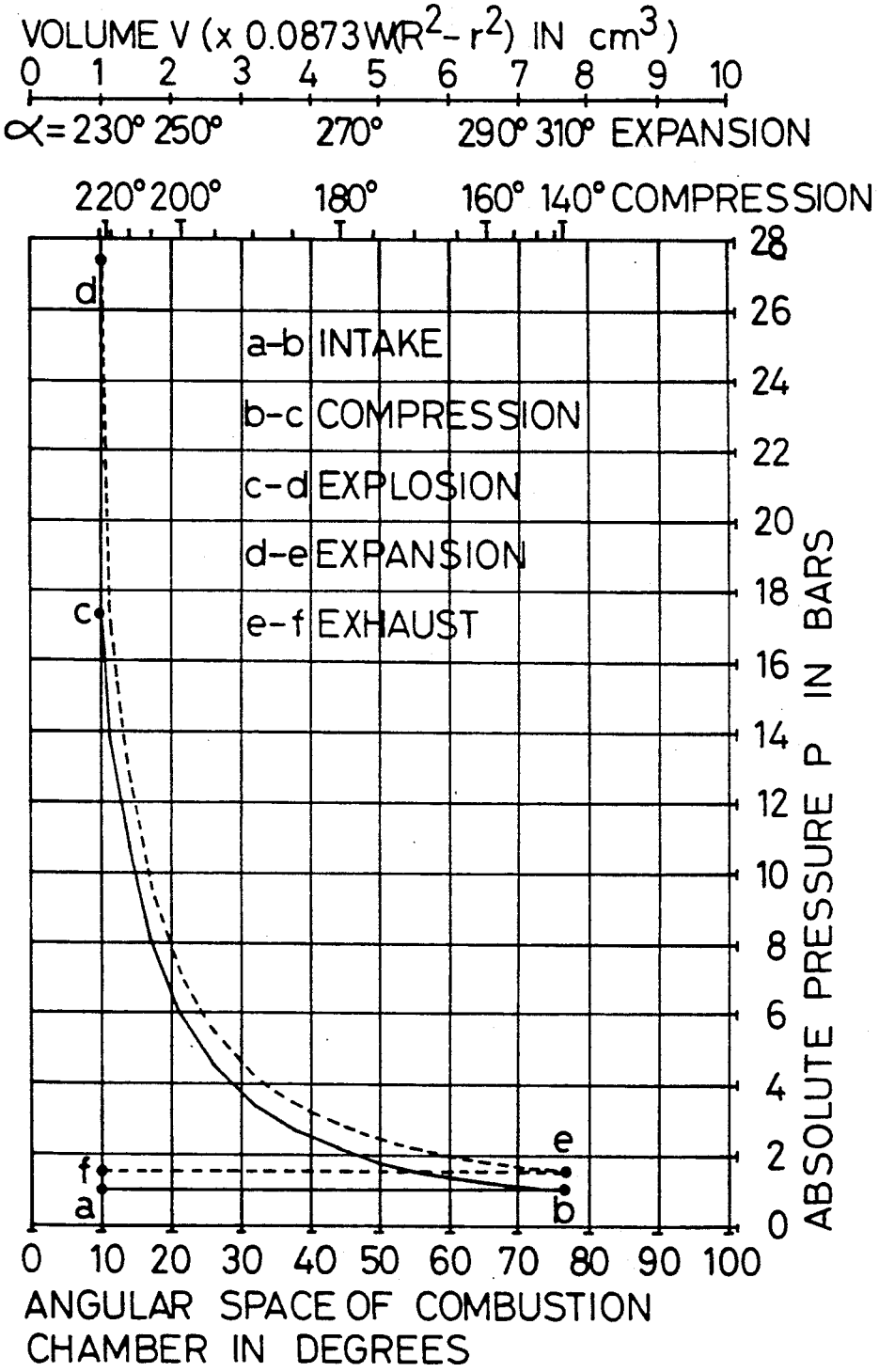
FIG. 14 is the pressure-volume diagram of combustion chamber 1 of the concentric rotary internal combustion engine.

At exactly $\alpha=225°$, the spark plug 8 fires initiating an instant explosion of the compressed fuel-air mixture. The combustion process can be considered as combination of isochoric and isobaric burning of the fuel by air. Depending on the kind and amount of fuel used, the pressure increases by half to 2½ times the final pressure of compression. In FIG. 14, it is assumed that final absolute pressure of compression increases by only 58 percent. The vertical line c-d stands for the explosion phase.

Starting from $\alpha=225°$ corresponding to point d in FIG. 14, when pressure is maximum and volume is minimum, to $\alpha=315°$ corresponding to point e in FIG. 14, when pressure is minimum and volume is maximum, the combustion chamber undergoes expansion. Again for simplicity and to facilitate computations, expansion is assumed isentropic process although it is polytropic.

The torsional moment $M_e$ during the power stroke must be overwhelming to overcome the torque requirement of the compression phase and at the same time provide brake power output which is the primary function of the engine 120.

As soon as the expansion ends, the outlet 24 is exposed, the volume of combustion chamber 1 shrinks and the by-products of combustion (basically water vapor and carbon dioxide) are discharged to the atmosphere. This is an isobaric and isothermal process as indicated by the horizontal line e-f in FIG. 14. An absolute pressure of 1.583 bars is maintained during the exhaust phase, instead of atmospheric because the discharging process is fast and continuous.

It is clear that the thermodynamic processes of the four stroke Otto internal combustion cycle are duplicated in concentric rotary internal combustion engine 120. The salient difference between the conventional piston-cylinder engine and the invention is that four complete Otto cycles occur in one cylinder of the latter every revolution in contrast to half Otto cycle per cylinder per rotation of the former.

NET POWER OUTPUT

Assuming that 60 percent of the difference between theoretical power production during expansion and power consumption during compression is lost due to accelerating moments, friction, leakage and other inefficiencies, the Net Power Output (NPO) of the concentric rotary internal combustion engine 120 is given by the formula:

$$NPO=(1-0.6)(w\times10^{-4})(M_e+M_c)$$

where NPO is in kilowatts, w is rotational speed of the engine in turns/second, and $M_e$ and $M_c$ are expansion and compression torsional moments, respectively, in kilogram force-centimeter.

During the power phase, the expansion torsional moment created is 95.709 $W(R^2-r^2)$ as computed below. It is the integral of the derivative of torsional moment with respect to angular space $dM_e/dA$ from minimum angular space of 10° to maximum angular space of 76.8°.

$$M_e = \int_{10^\circ}^{76.8^\circ} dM_e = \int_{10^\circ}^{76.8^\circ} [\ Wpa^{1.4}(R^2 - r^2)/360] \times A^{-0.4}dA$$
$$= \int_{10^\circ}^{76.8^\circ} \frac{[3.1416W(27.442\text{ bars})\ (10^\circ)^{1.4}(R^2 - r^2)]dA}{360\ A^{0.4}}$$
$$= \int_{10.0^\circ}^{76.8^\circ} 6.0154W(R^2 - r^2)\ A^{-0.4}dA$$
$$= \left.\frac{6.0154W(R^2 - r^2)\ A^{0.6}}{0.6}\right|_{10.0^\circ}^{76.8^\circ}$$
$$= 10.0257W(R^2 - r^2)(76.8^{0.6} - 10.0^{0.6})$$
$$= 95.709W(R^2 - r^2)$$

During the compression phase, the compression torsional moment absorbed by the vanes 70, 70' is $-60.539\ W(R^2-r^2)$ as computed below. The derivative of compression torsional moment with respect to angular space $dM_c/dA$ is integrated from maximum angular space of 76.8° to minimum space of 10° to obtain the torsional moment consumed by combustion chamber 1 during the compression phase.

$$M_e = \int_{76.8^\circ}^{10.0^\circ} dM_e = \int_{76.8^\circ}^{10.0^\circ} [\ Wpa^{1.4}(R^2 - r^2)/360] \times A^{-0.4}dA$$
$$= \int_{76.8^\circ}^{10^\circ} \frac{[3.1416W(1\text{ bar})\ (76.8^\circ)^{1.4}(R^2 - r^2)]dA}{360\ A^{0.4}}$$
$$= \int_{76.8^\circ}^{10.0^\circ} 3.805W(R^2 - r^2)\ A^{-0.4}dA$$
$$= \left.\frac{3.805W(R^2 - r^2)\ A^{0.6}}{0.6}\right|_{76.8^\circ}^{10.0^\circ}$$
$$= -6.341W(R^2 - r^2)(10.0^{0.6} - 76.8^{0.6})$$
$$= -60.539W(R^2 - r^2)$$

The initial absolute pressures p, p and angular spaces a, a of combustion chamber 1 used in the above computations are obtained from Tables 1 and 2. FIG. 14 can be referred to with equal facility. Graphically in FIG. 14, the expansion torsional moment $M_e$ is the area under the curve d-e, the compression torsional moment $M_c$ is the area under the curve b-c, and the net torsional moment $M_e$-$M_c$ is the area between the curves d-e and b-c.

Plugging in the results of the computations in the NPO equation, $$NPO = 0.4\ w \times 10^{-4}(95.709 - 60.539) \times W(R^2 - r^2)$$
$$= 0.0014\ wW(R^2 - r^2)$$

The result of the above computation is the expression for net power output of combustion chamber 1 only. Since there are four combustion chambers, it must be multiplied by 4 to arrive at the theoretical net power output of the concentric rotary internal combustion engine 120:

$$NPO = 0.0056wW(R^2 - r^2)$$

Assuming a concentric rotary internal combustion engine running at w=50 turns/second and having dimensions twice as big as depicted in the accompanying drawings of FIGS. 2, 3, and 4, such as follows: axial width of combustion chamber W=7.2 centimeters, inside radius of the shell R=9 centimeters, and radius of rotor cylinder r=4 centimeters; its theoretical net power output is 131 kilowatts.

CONCENTRIC ROTARY EXTERNAL COMBUSTION ENGINES, HYDRAULIC MOTOR, LIQUID PUMP, VACUUM PUMP AND COMPRESSOR

Figure 15:
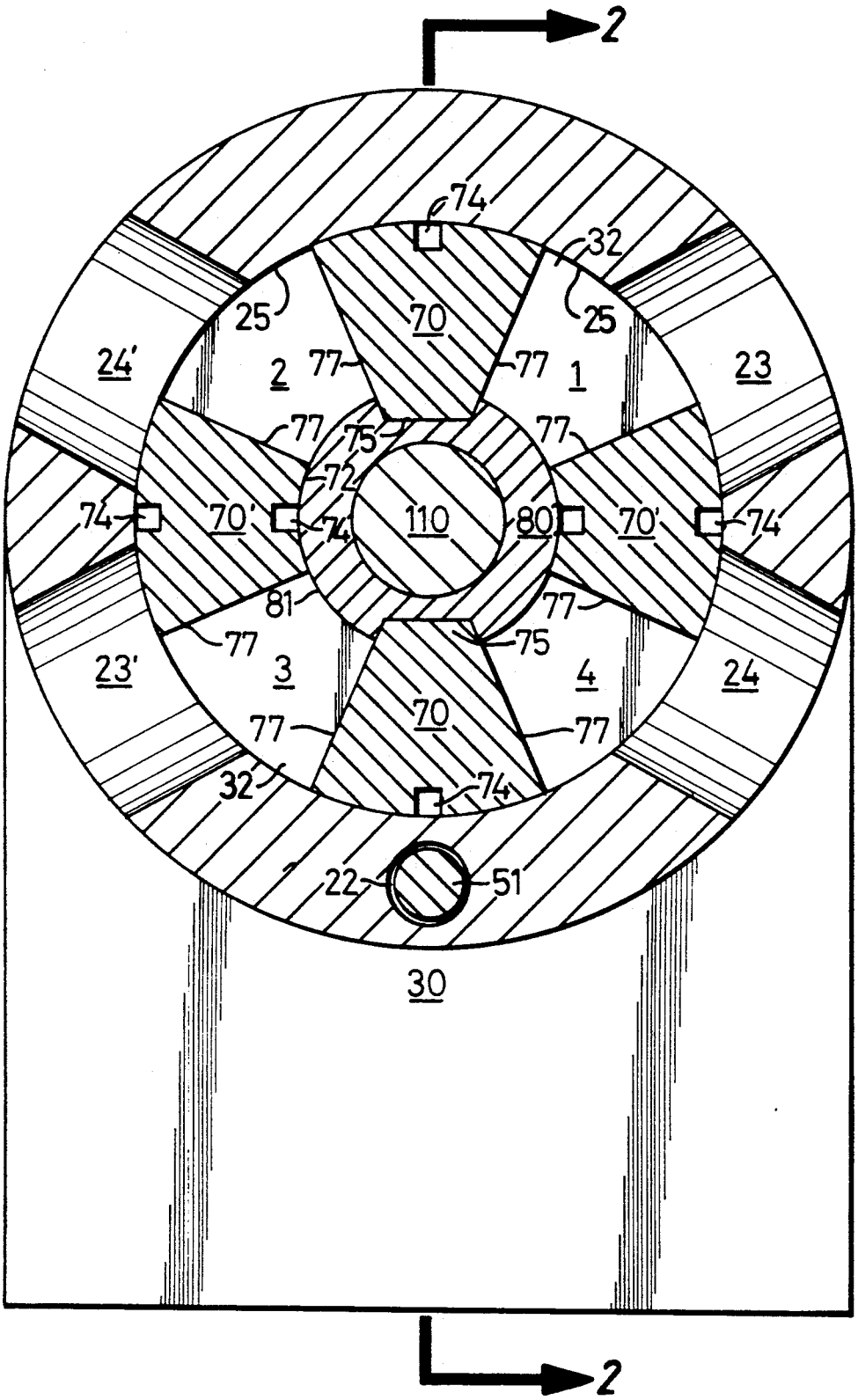
FIG. 15 is the transverse section along section line 4—4 of FIG. 2, showing the internal features of the working chamber common to the concentric rotary external combustion engines, hydraulic motor, liquid pump, vacuum pump and compressor.

In FIG. 15, the threaded hole 21 for accommodation of the spark plug 8 on the left side of the working chamber 140 is elliminated, and a second set of inlet 23' and outlet 24' is provided in locations on the left side of the shell 20 symmetrically corresponding to the locations of the first set of inlet 23 and outlet 24 on the right side of said shell 20. Since the four ports 23, 24, 23', 24' are identical in dimensions and angular distances from the horizontal plane bisecting the working chamber 140, the axial section of said working chamber 140 is symmetrical in both horizontal and vertical axes passing through the center. The distance from edge to edge as measured on the internal circumferential surface 25 of the shell 20 between the inlet 23 and outlet 24 as well as between the inlet 23' and outlet 24' is the minimum angular space inside the variable-volume-chamber 1, 2, 3, or 4. Whereas, the distance from edge to edge between the right inlet 23 and left outlet 24' as well as the left inlet 23' and right outlet 24 is the maximum angular space inside the variable-volume-chamber 1, 2, 3 or 4. FIG. 15 shows variable-volume chambers 1 and 3 to have maximum angular space and variable-volume chambers 2 and 4 to have minimum angular space.

The above mensuration allows the variable-volume-chambers 1, 2, 3, 4 to always communicate with only one port 23, 24, 23' or 24' preventing leakage through said ports. It also allows the gradual and continuous enlargement of the variable-volume-chambers 1, 2, 3, 4 from minimum volume to maximum volume during intake, as well as their shrinking from maximum volume to minimum volume during discharge, thus maximizing capacity and benefits from the expansion, compression and pumping processes.

It is apparent that with the above minor changes, the apparatus can be made to develop power by operating it as an external combustion engine or a hydraulic motor, or alternatively, to absorb external power to perform pumping or compression by operating it as a liquid pump, vacuum pump or compressor.

External Combustion Engines

The apparatus depicted in FIG. 15 can effectively work as a steam engine if both inlets 23, 23' are connected to a source of high pressure steam while both outlets 24, 24' are communicating with either a condenser or the atmosphere. Steam at high pressure and temperature enters the variable-volume-chambers 1, 2, 3, 4 through both inlets 23, 23', creates torsional moment as it causes the variable-volume-chambers 1, 2, 3, 4 to expand and revolve around their common axis, and leaves at low pressure and temperature the said variable-volume-chambers 1, 2, 3, 4 via both outlets 24, 24'.

The apparatus shown in FIG. 15 can also work like a gas turbine engine if the latter's combustor is adapted and installed between the inlet 23' and outlet 24' on the left side, while on the other side, both inlet 23 and outlet 24 communicate with the atmosphere. Atmospheric air is drawn into the variable-volume-chambers 1, 2, 3, 4 through the right inlet 23 as the result of the enlarging of their volumes as they pass by said inlet 23. Then, the air is compressed while being discharged into the air plenum of the conventional combustor via the left outlet 24'. The pressurized air enters the flame tube of the conventional combustor through orifices. Inside said flame tube, the air mixes with fuel introduced by a nozzle. Combustion is initiated by a lone spark, after which it becomes a continuous process. The heated gases possessing high pressure and temperature is admitted into the variable-volume-chambers 1, 2, 3, 4 via the left inlet 23' which is directly connected to the said flame tube. Consequently, the variable-volume-chambers 1, 2, 3, 4 are forced to enlarge, revolve and develop torsional moment required to sustain the compression work and make available brake power output. After performing work, the gases is discharged at low pressure and temperature to the atmosphere via the right outlet 24.

Hydraulic Motor

The apparatus shown in FIG. 15 as a hydraulic motor is operated by a pump. To make certain that it will start to operate, the right inlet 23 and left outlet 24' as well as the left inlet 23' and the right outlet 24 must be apart from edge to edge by less than the maximum angular space inside the variable-volume-chamber 1, 2, 3 or 4. The discharge of said pump is connected to both inlets 23, 23' while both outlets 24, 24' connect to its suction. Consequently, when the pump runs, the variable-volume-chambers 1, 2, 3, 4 are always at high pressure while passing by the inlets 23, 23' and they are at low pressure when passing by the outlets 24, 24'. The end result is the transmission of the pump power output into brake power output of the hydraulic motor.

Liquid Pump

In the case when the apparatus shown in FIG. 15 is utilized as a pump, the variable-volume-chambers 1, 2, 3, 4 draw in liquid at low pressure while passing by the inlets 23, 23' connected to the source of liquid, because they are enlarging; and discharge the same liquid at high pressure while passing by the outlets 24, 24' because they are shrinking. Clearly, the concentric rotary pump is a positive displacement type.

Vacuum Pump

For this application, the inlets 23, 23' of the apparatus in FIG. 15 are connected to the enclosed volume required to be depressurized or cleared of gas, while the outlets 24, 24' communicate with the atmosphere. The enlarging of the variable-volume-chambers 1, 2, 3, 4 as they pass by the inlets 23, 23' creates suction effect causing the evacuation of gases from said enclosed container. Suction temporarily ends when each variable-volume-chamber 1, 2, 3 or 4 achieves maximum volume, after which the gases is discharged to the atmosphere via the outlet 24 or 24'. When it has minimum volume and the inlet 24 or 24' is impending to open, the variable-volume-chamber is ready for the next gas pumping cycle.

Compressor

In the last application, both inlets 23, 23' of the apparatus shown in FIG. 15 are connected to the source of gas or air required to be compressed while both outlets 24, 24' are connected to a pressure vessel or an appropriate place. The operation of the compressor is like that of the pump except that the fluid involved is gas or air. The variable-volume-chambers 1, 2, 3, 4 draw in gas or air at low pressure while passing by the inlets 23, 23' because they are enlarging; and discharge the same gas or air at high pressure and temperature while passing by the outlets 24, 24' because they are shrinking.

Capacity

Ideally, the capacity Q of the apparatus shown in FIG. 15 should be constant at a specific rotative speed w irrespective of pressure and power absorbed or produced for it is a positive displacement pressure fluid machine. However, because of leakage required for lubricating the rubbing parts, capacity Q slightly decreases with pressure. Apparently, the most important performance parameter of said apparatus is capacity Q.

The capacity Q in liters/second of the apparatus shown in FIG. 15 is given by the formula:

$$Q = qnNwW(1-L)(A-a)(R^2-r^2)/360{,}000$$

where:

q = 3.1416
n = Number of inlets or outlets = 2
N = Number of variable-volume-chambers = 4
w = Rotative speed in turns/second
W = Axial width of working chamber in centimeters
L = Leakage expressed as a fraction of 1
A = Maximum angular space of the a variable-volume-chamber in degrees
a = Minimum angular space of a variable-volume-chamber in degrees
R = Internal radius of the shell in centimeters
r = RAdius of rotor cylinders in centimeters
360,000 = Product of number of degrees in one revolution and number of cubic centimeters in one liter = 360 × 1,000

CONCLUSION

The main difference between the concentric rotary internal combustion engine 120 and the apparatus that can work as either external combustion engine, hydraulic motor, liquid pump, vacuum pump or compressor is on the number of ports. While the former has only one radial inlet 23 and one radial outlet 24, the latter has two diametrically opposing inlets 23, 23' and two diametrically opposing outlets 24, 24'. Except for the spark plug 8, both versions of the invention are practically similar in all respects.

The following are claimed as new:

1. A concentric rotary pressure fluid machine made up of a stator, an intermediate elliptical gears and main shaft assembly, a pair of coaxial rotors and their axial spacer, a. said stator comprising a shell in the middle, a pair of identical gear box bodies in front and rear transverse sides of said shell, and a pair of identical gear box cover plates at both ends, fastened together, in which:

i. said shell comprises:

1) a right circular cylindrical internal surface having an axis 2) a longitudinal hole parallel to said axis 3) one or two pairs of ports located half the minimum angular space of the variable-volume-chamber above or below from the horizontal plane bisectpr of the shell to their nearest edges;

ii. each gear box body comprises:

1) an outer transverse side 2) an oblong recess in said outer transverse side 3) a first longitudinal hole in said oblong recess, coaxial with its bottom semi-circular circumferential surface 4) a second longitudinal hole in said oblong recess, coaxial with its top semi-circular circumferential surface, with a gas seal and an anti-friction bearing 5) an inner transverse side 6) a cylindrical tongue in said inner transverse side having identical diameter as that of the internal surface of said shell serving as end plate of working chamber and facilitating the mounting and alignment of said shell;

iii each gear box cover plate comprises:

1) an inner transverse side 2) an oblong tongue in said inner transverse side having identical transverse dimensions as the oblong recess of said gear box body facilitating its mounting and alignment 3) a longitudinal hole in said oblong tongue with oil seal and anti-friction bearing corresponding coaxially with the first longitudinal hole of said gear box body 4) a longitudinal blind hole in said oblong tongue with anti-friction bearing corresponding coaxially with the second longitudinal hole of said gear box body;

b) said intermediate elliptical gears and mains shaft assembly transmitting the brake power in which:

i. a main shaft passes longitudinally through said lomgitudinal hole of the sheel and said first longitudinal holes of the gear box bodies as well as journalled for rotation in the longitudinal holes of the gear box cover plates ii. a pair of identical intermediate elliptical gears are mounted and keyed to said main shaft;

c. said pair of coaxial rotors and their axial spacer rotatably mounted inside the stator, each rotor comprising a pair of vanes, a rotorcyclinder, a rotor shaft and a rotor elliptical gear, in which:

i. each vane comprises:

1) an outer circumferential convex surface having radius of curvature virtually equal to the internal radius of the shell, which is journalled for rotation inside the right circular cylindrical internal surface of said shell 2) an inner circumferential concave surface 3) a wedge-shaped base inwardly projecting from one side of its inner circumferential concave surface 4) a countersunk hole transversely passing through said wedge-shaped base 5) transverse surfaces 6) a groove running perpendicular to its direction of travel containing hot gases for lubrication and dynamic sealing in the inner and outer circumferential surfaces and transverse surface of said vane;

ii. each rotor cylinder comprises:

1) a circumferential surface having radius of curvature virtually equal to that of said inner circumferential concave surfaces of the vane, and rotatably journalled between the inner circumferential concave surfaces of the pair of vanes screwed to the other rotor cylinder 2) a pair of diametrically opposing wedge-shaped longitudinal grooves identical in shape and size to said wedge-shaped bases of the vanes screwed to it 3) a threaded diametrical hole coaxial with the countersunk holes of the vanes screwed to it 4) an axial cylindrical recess in the inner transverse surface for journalling the axial spacer;

iii. said rotor shaft outwardly and coaxially projects from said rotor cylinder and is journalled for rotation in the second longitudinal hole of the gear box body and the longitudinal blind hole of the gear box cover plate iv. said rotor elliptical gear is mounted and keyed to said rotor shaft and enmeshed with said intermediate elliptical gear inside the gear box v. said axial spacer has a disc plate serving as thrust bearing for the inner transverse surfaces of the rotor cylinders, and a pair of journals projecting outwardly and coaxially from said disc plate serving as radial bearings for the cylindrical recesses in the inner transverse surfaces of said rotor cylinders.

2. The apparatus as claimed in 1 having four identical elliptical gears that actuate its four variable-volume-chambers defined by the internal surface of the shell, pair of rotor cylinders and spacer, two pairs of arcuate vanes and the two transverse end plates to symmetrically and alternately enlarge and shrink twice every revolution.

3. The apparatus as claimed in 1 applied as an internal combustion engine in which the shell has a threaded horizontal radial hole on the left for fixing a spark plug, a radial fuel-air mixture inlet and exhaust outlet on the right, and the rear end of the main shaft is a square cam operating the contact breaker of the ignition system.

4. The apparatus as claimed in 1 applied either as an external combustion engine, hydraulic motor, liquid pump, vacuum pump or compressor in which the shell has two diametrically opposing inlets and two diametrically opposing outlets.

* * * * *